US009364935B2

(12) United States Patent
Fuller

(10) Patent No.: US 9,364,935 B2
(45) Date of Patent: Jun. 14, 2016

(54) APPARATUS, SYSTEM AND METHOD FOR AERO-CONTOURING A SURFACE OF AN AERODYNAMICALLY FUNCTIONAL COATING

(71) Applicant: The Boeing Company, Chicago, IL (US)

(72) Inventor: Mark D. Fuller, Snohomish, WA (US)

(73) Assignee: The Boeing Company, Chicago, IL (US)

( * ) Notice: Subject to any disclaimer, the term of this patent is extended or adjusted under 35 U.S.C. 154(b) by 250 days.

(21) Appl. No.: 13/965,174

(22) Filed: Aug. 12, 2013

(65) Prior Publication Data

US 2015/0104998 A1 Apr. 16, 2015

(51) Int. Cl.

| | |
|---|---|
| ***B24B 23/03*** | (2006.01) |
| ***B24B 23/00*** | (2006.01) |
| ***B24B 55/10*** | (2006.01) |

(52) U.S. Cl.

CPC ..... *B24B 23/03* (2013.01); *B24B 23/005* (2013.01); *B24B 55/102* (2013.01)

(58) Field of Classification Search

CPC ..... B24B 23/02; B24B 23/03; B24B 23/04; B24B 55/10; B24B 55/102; B24B 55/105; B24B 23/026

USPC ..... 451/354, 357, 358, 359, 451, 456, 457

See application file for complete search history.

(56) References Cited

U.S. PATENT DOCUMENTS

| | | | |
|---|---|---|---|
| 3,284,961 | A | 11/1966 | Graves |
| 3,785,092 | A | 1/1974 | Hutchins |
| 4,531,329 | A | 7/1985 | Huber |

(Continued)

FOREIGN PATENT DOCUMENTS

| | | | |
|---|---|---|---|
| CN | 104369084 | A | 2/2015 |
| EP | 1293296 | A2 | 3/2003 |

(Continued)

OTHER PUBLICATIONS

Holmes, Bruce J., et al., "Manufacturing Tolerances for Natural Laminar Flow Airframe Surface", SAE Paper 850863 Presented at 1985 SAE General Aviation Meeting, Wichita, Kansas, Apr. 16-19, 1985, 11 pages.

Obara, Clifford J., et al., "Roughness and Waviness Requirements for Laminar Flow Surfaces", NASA Conference Publication CP2397, in its Langley Symposium on Aerodynamics, vol. 1, Accession No. N88-14953, Dec. 1986, pp. 519-537.

(Continued)

*Primary Examiner* — Monica Carter
*Assistant Examiner* — Marcel Dion

(57) ABSTRACT

An aero-contouring apparatus is provided. The aero-contouring apparatus has a housing assembly and a motor assembly disposed therein. The motor assembly has a motor unit and a drive unit. The aero-contouring apparatus further has an engagement force/tilt limiting member coupled to the housing assembly, which has a central opening and a bottom end configured to contact a surface to be aero-contoured of an aerodynamically functional coating applied to a structure. The aero-contouring apparatus further has an abrading unit coupled to the drive unit and inserted through the central opening in non-contact communication with the engagement force/tilt limiting member. The abrading unit is driven by the drive unit in a random orbit motion on the surface. The engagement force/tilt limiting member mechanically limits both an engagement force and any tilting motion of the abrading unit with respect to the surface.

20 Claims, 17 Drawing Sheets

(56) References Cited

U.S. PATENT DOCUMENTS

| | | | | | |
|---|---|---|---|---|---|
| 4,934,475 | A | * | 6/1990 | Urakami | 180/164 |
| 5,031,364 | A | * | 7/1991 | Belanger | 451/359 |
| 5,105,585 | A | | 4/1992 | Hampl et al. | |
| 5,237,781 | A | * | 8/1993 | Demetrius | 451/456 |
| 5,545,080 | A | * | 8/1996 | Clowers et al. | 451/359 |
| 5,592,998 | A | * | 1/1997 | Urakami | B62D 57/00 180/164 |
| 5,919,085 | A | | 7/1999 | Izumisawa | |
| 5,993,305 | A | * | 11/1999 | Chu | 451/357 |
| 2002/0132570 | A1 | * | 9/2002 | Berg et al. | 451/344 |
| 2008/0032603 | A1 | * | 2/2008 | Manor | 451/11 |
| 2009/0117834 | A1 | | 5/2009 | D'Alessandro et al. | |
| 2012/0186520 | A1 | * | 7/2012 | Hill | 118/713 |

FOREIGN PATENT DOCUMENTS

| | | | |
|---|---|---|---|
| EP | 2596908 | A1 | 5/2013 |
| EP | 2837465 | A1 | 2/2015 |

OTHER PUBLICATIONS

Joslin, Ronald D., "Overview of Laminar Flow Control", NASA/TP-1998-208705, Langley Research Center, Hampton, Virginia, Oct. 1998, 142 pages.

NASA CR-1999-209325, "High Reynolds Number Hybrid Laminar Flow Control (HLFC) Flight Experiment III. Leading Edge Design, Fabrication, and Installation", Prepared for Langley Research Center under Contract NAS1-18574, Apr. 1999, 92 pages.

Arnal, D., et al., "Laminar-Turbulent Transition Control: NLF, LFC, HLFC", RTO-EN-AVT-151, NATO-OTAN, 2008, pp. 15-1 to 15-2.

3M Mini Random Orbital Nib Sander brochure and information, 3M Abrasive Systems Division, St. Paul, MN, 2008, 7 pages.

3M Industrial Products Catalog of Accessories for Abrasive Products, 3M Abrasive Systems Division, St. Paul, MN 2012, 68 pages.

European Patent Office Extended European Search Report for Counterpart Patent Application No. EP14178493.4-1702, Applicant The Boeing Company, dated Nov. 4, 2014, 6 pages.

* cited by examiner

APPARATUS, SYSTEM AND METHOD FOR AERO-CONTOURING A SURFACE OF AN AERODYNAMICALLY FUNCTIONAL COATING

BACKGROUND

1) Field of the Disclosure

The disclosure relates generally to devices, methods and systems for aero-contouring surfaces of structures and collecting abrading debris, and more specifically, to devices, methods and systems for aero-contouring surfaces of aerodynamically functional coatings applied to structures of air vehicles, such as aircraft, and collecting abrading debris.

2) Description of Related Art

Air vehicles, such as commercial passenger and cargo aircraft, may have exterior surfaces that are coated or painted with colorful and decorative designs. For example, such exterior surfaces of an air vehicle may include exterior surfaces of the tail, wings, fuselage, nacelles, or other exterior surfaces of the air vehicle. Such colorful and decorative designs may include airline livery designs which are standard paint schemes on aircraft that prominently display an airline's logo, name, or other identifying feature to provide branding and differentiation of the airline. Since airline livery designs may provide not only a decorative function, but also a branding and differentiation function, it is important that livery designs be consistently applied and with acceptable appearance, gloss, and long-term durability.

In addition, maintaining desired air flow characteristics over coated or painted aircraft surfaces, such as airline livery designs, for example, coated or painted on the tail of an aircraft, may be challenging. In order to avoid impact on desired boundary layer characteristics during flight, there are allowable criteria for paint edges and waviness. There may also exist restrictions for three-dimensional surface discontinuities, such as those that may occur from inclusions caused by debris, dust, or dry coating overspray, which may be more stringent than for paint edges or for waviness.

Known devices, systems and methods exist for abrading or sanding coated or painted surfaces in order to smooth and polish the surfaces. However, smoothing and polishing of coating or paint edges of aerodynamically functional coatings, such as decorative livery designs, may require a manual process performed at a very high skill level and may require an extensive amount of time to achieve. A manual process performed by skilled operators may not scale well to the large areas and manufacturing rates required for commercial aircraft livery due to the time and skill required. Moreover, if lesser-skilled operators are used to perform the abrading or sanding, excessive pressure may inadvertently be applied to the surface during abrading or sanding, and/or gouging of the surface may occur if the abrading or sanding device is inadvertently tipped to the side. Further, although sanding with known sanding devices may be performed on coating or paint edges of decorative livery designs, this may not be a viable manufacturing method for exterior decorative livery design coatings or paints where appearance, gloss and long-term durability may be required.

Accordingly, there is a need in the art for improved devices, systems and methods for aero-contouring surfaces of aerodynamically functional coatings or paints of decorative designs, such as airline livery designs, applied to structures, such as structures of air vehicles, that provide advantages over known devices, systems and methods.

SUMMARY

This need for improved devices, systems and methods for aero-contouring surfaces of aerodynamically functional coatings or paints of decorative designs, such as airline livery designs, applied to structures, such as structures of air vehicles, is satisfied by this disclosure. As discussed in the below detailed description, embodiments of the improved devices, systems and methods for aero-contouring surfaces of aerodynamically functional coatings or paints of decorative designs, such as airline livery designs, applied to structures, such as structures of air vehicles, may provide significant advantages over known methods and systems.

In one embodiment of the disclosure, there is provided an aero-contouring apparatus. The aero-contouring apparatus comprises a housing assembly. The aero-contouring apparatus further comprises a motor assembly disposed within the housing assembly. The motor assembly comprises a motor unit and a drive unit.

The aero-contouring apparatus further comprises an engagement force/tilt limiting member coupled to the housing assembly. The engagement force/tilt limiting member has a central opening and has a bottom end configured to contact a surface to be aero-contoured of an aerodynamically functional coating applied to a structure. The aero-contouring apparatus further comprises an abrading unit coupled to the drive unit and inserted through the central opening in non-contact communication with the engagement force/tilt limiting member. The abrading unit is driven by the drive unit in a random orbit motion on the surface.

The housing assembly, the motor assembly, the engagement force/tilt limiting member, and the abrading unit, together comprise an aero-contouring apparatus for aero-contouring the surface to be aero-contoured, wherein the engagement force/tilt limiting member mechanically limits both an engagement force and any tilting motion of the abrading unit with respect to the surface. Optionally, the aero-contouring apparatus may comprise a vacuum outlet port configured for attachment to a debris collection device.

In another embodiment of the disclosure, there is provided an aero-contouring system. The aero-contouring system comprises a structure coated with an aerodynamically functional coating having a surface to be aero-contoured.

The aero-contouring system further comprises an aero-contouring apparatus for aero-contouring the surface. The aero-contouring apparatus comprises a housing assembly and a motor assembly disposed within the housing assembly. The motor assembly comprises a motor unit and a drive unit.

The aero-contouring system further comprises an engagement force/tilt limiting member coupled to the housing assembly. The engagement force/tilt limiting member has a central opening and has a bottom end configured to contact a surface to be aero-contoured of an aerodynamically functional coating applied to a structure. The aero-contouring system further comprises an abrading unit coupled to the drive unit and inserted through the central opening in non-contact communication with the engagement force/tilt limiting member. The abrading unit is driven by the drive unit in a random orbit motion on the surface. The engagement force/tilt limiting member mechanically limits both an engagement force and any tilting motion of the abrading unit with respect to the surface. Optionally, the aero-contouring system may comprise a debris collection system for attachment to the aero-contouring apparatus further comprising a vacuum outlet port.

In another embodiment of the disclosure, there is provided a method of aero-contouring a surface of an aerodynamically functional coating applied to a structure. The method comprises the step of contacting with an aero-contouring apparatus a surface to be aero-contoured of an aerodynamically functional coating applied to a structure.

The aero-contouring apparatus comprises a housing assembly and a motor assembly disposed within the housing assembly. The motor assembly comprises a motor unit and a drive unit. The aero-contouring apparatus further comprises an engagement force/tilt limiting member coupled to the housing assembly. The engagement force/tilt limiting member has a central opening. The aero-contouring apparatus further comprises an abrading unit coupled to the drive unit and inserted through the central opening in non-contact communication with the engagement force/tilt limiting member. Optionally, the aero-contouring apparatus may comprise a vacuum outlet port configured for attachment to a debris collection system.

The method further comprises the step of moving the aero-contouring apparatus in a random orbit motion on the surface to abrade and smooth the surface. The method further comprises the step of mechanically limiting with the engagement force/tilt limiting member an engagement force and any tilting motion of the abrading unit with respect to the surface. The method further comprises the step of removing any surface inclusions and coating edges on the surface without resulting in excessive engagement force to the surface and without gouging the surface.

The features, functions, and advantages that have been discussed can be achieved independently in various embodiments of the disclosure or may be combined in yet other embodiments further details of which can be seen with reference to the following description and drawings.

BRIEF DESCRIPTION OF THE DRAWINGS

The disclosure can be better understood with reference to the following detailed description taken in conjunction with the accompanying drawings which illustrate preferred and exemplary embodiments, but which are not necessarily drawn to scale, wherein.

DETAILED DESCRIPTION

Disclosed embodiments will now be described more fully hereinafter with reference to the accompanying drawings, in which some, but not all of the disclosed embodiments are shown. Indeed, several different embodiments may be provided and should not be construed as limited to the embodiments set forth herein. Rather, these embodiments are provided so that this disclosure will be thorough and will fully convey the scope of the disclosure to those skilled in the art.

Figure 1A:
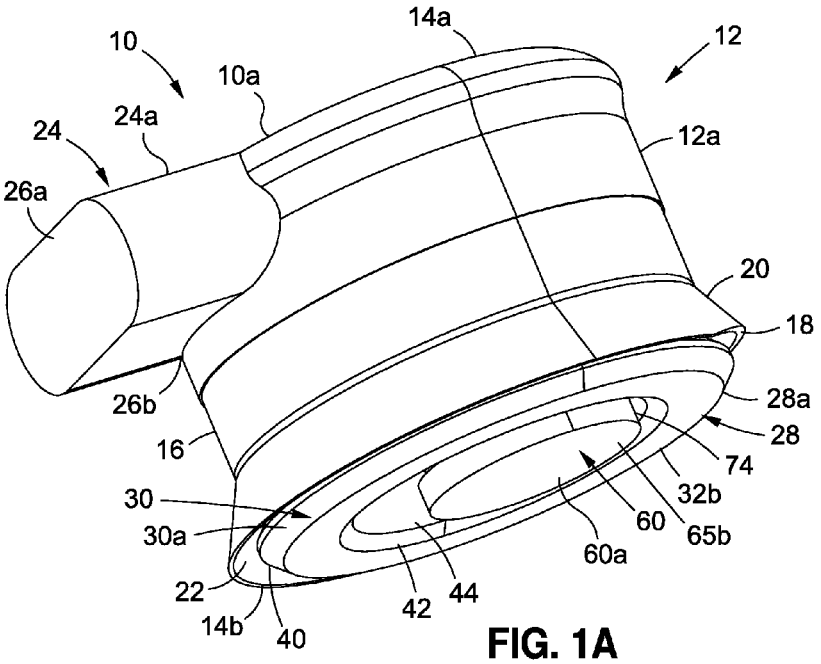
FIG. 1A is an illustration of a side perspective view of an embodiment of an aero-contouring apparatus of the disclosure for aero-contouring a surface.
Figure 1B:
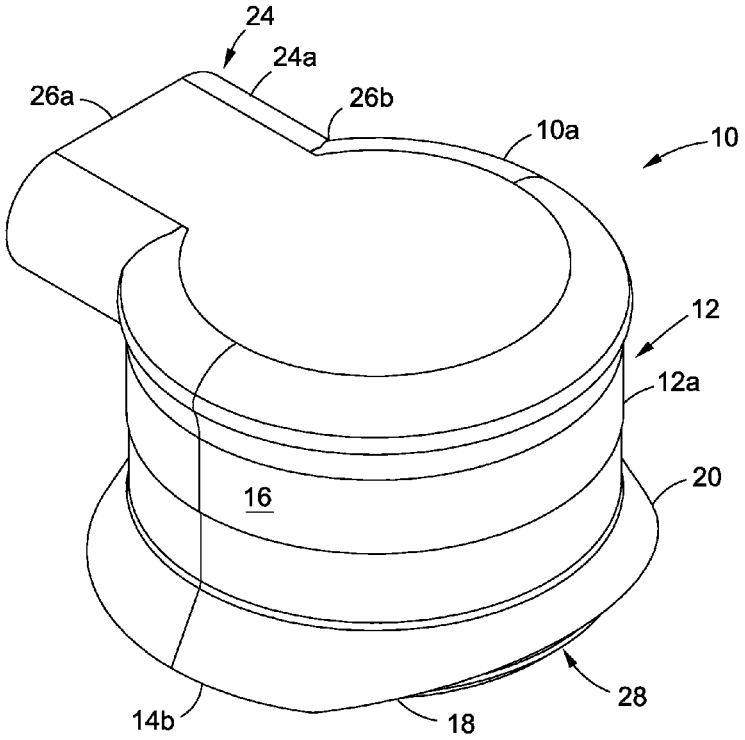
FIG. 1B is an illustration of a top perspective view of the aero-contouring apparatus of FIG. 1A.
Figure 1C:
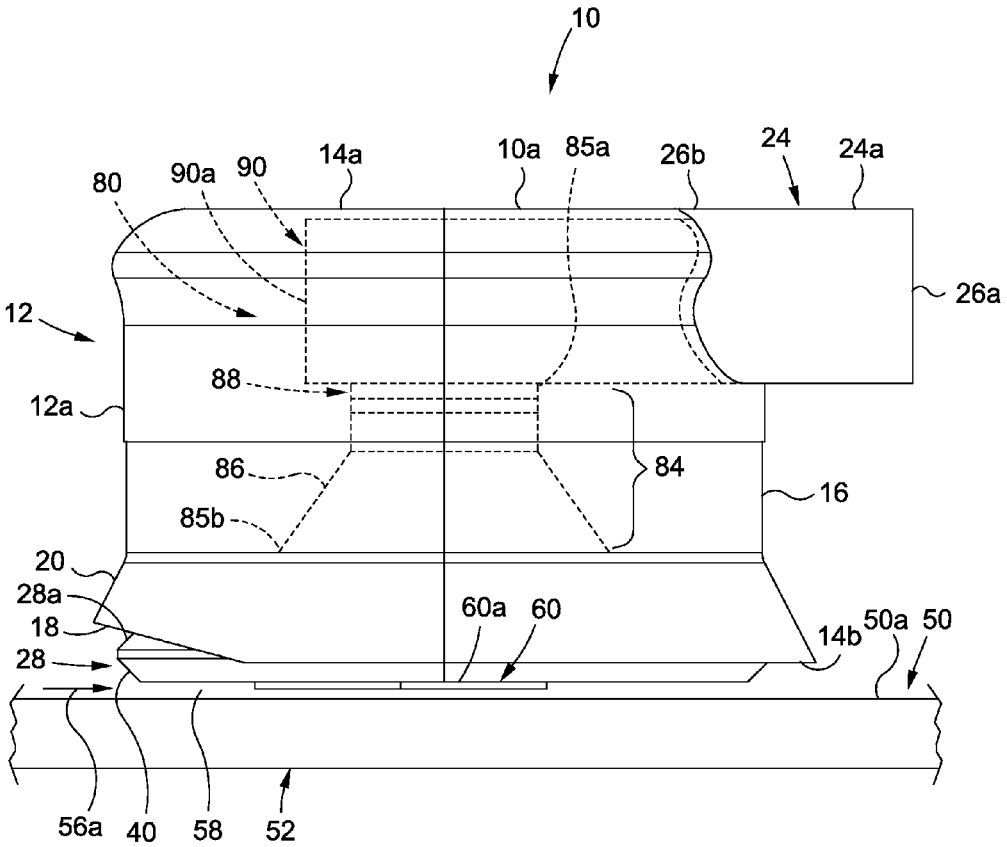
FIG. 1C is an illustration of a side view of the aero-contouring apparatus of FIG. 1A showing various internal components in phantom lines.
Figure 4A:
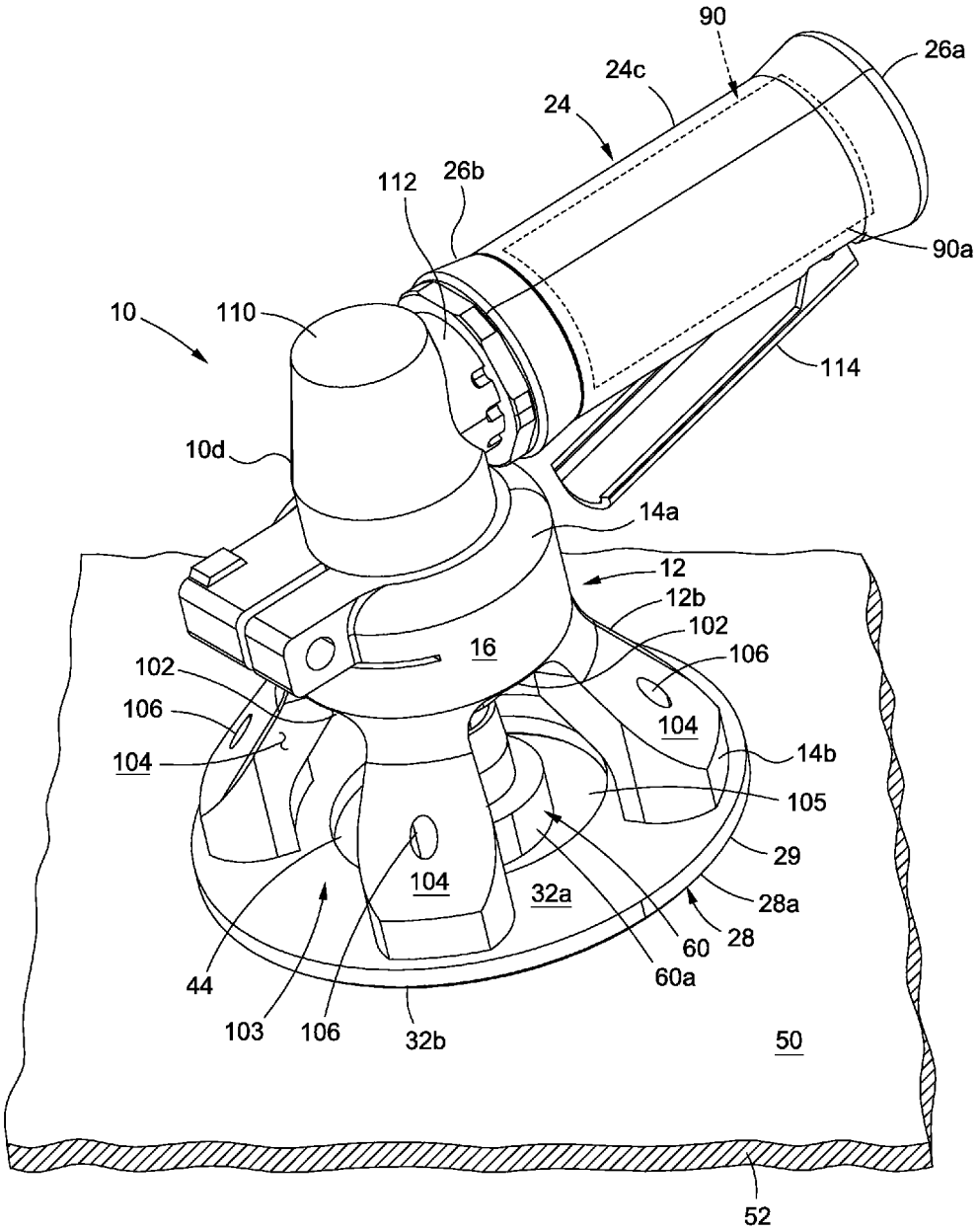
FIG. 4A is an illustration of a front perspective view of yet another embodiment of an aero-contouring apparatus of the disclosure for aero-contouring a surface.
Figure 8:
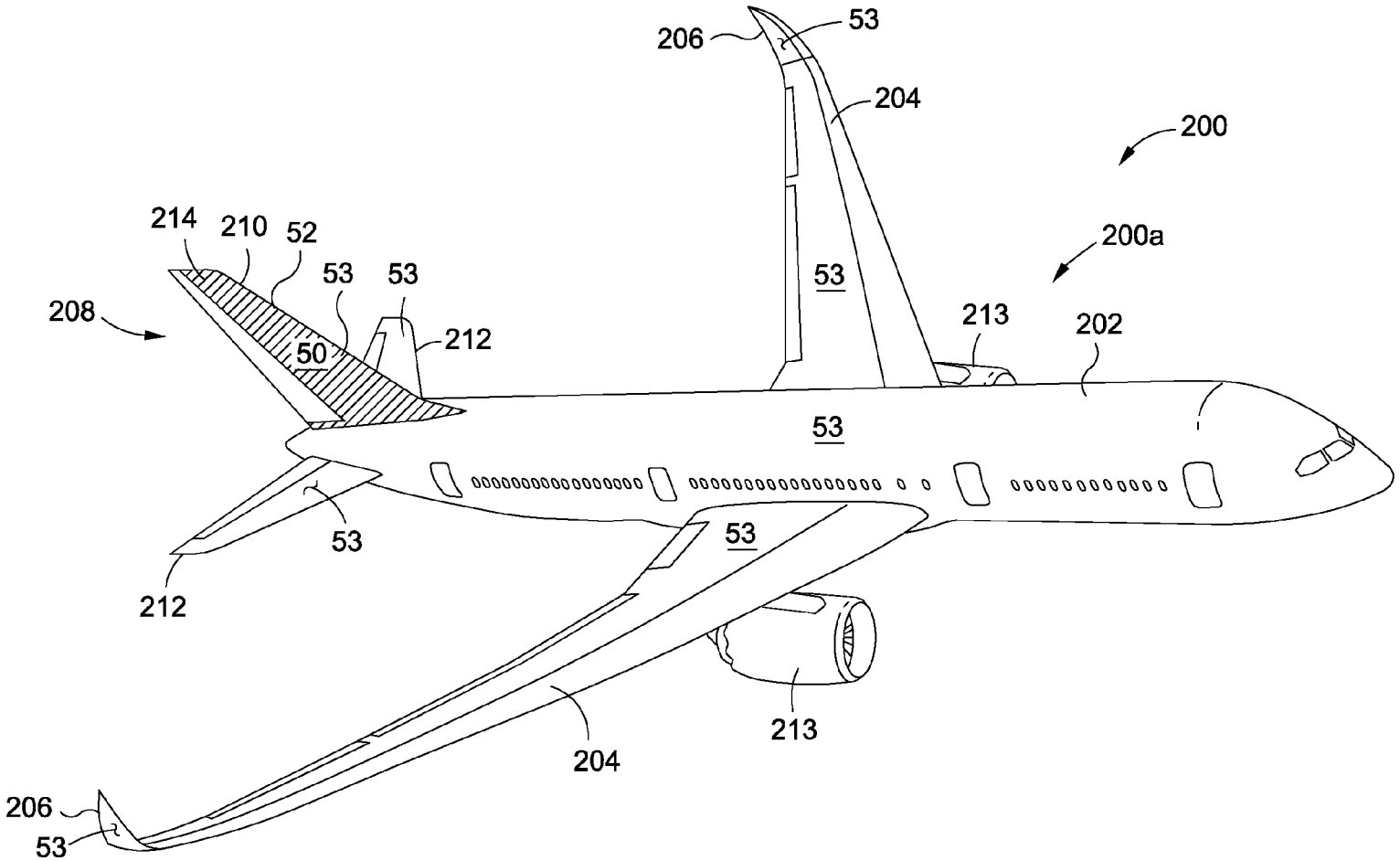
FIG. 8 is a perspective view of an air vehicle that may incorporate one or more surfaces to be aero-contoured with one or more embodiments of the aero-contouring apparatus and aero-contouring system of the disclosure.

Now referring to the Figures, FIGS. 1A-2C and 4A-5C show various embodiments of an aero-contouring apparatus 10 of the disclosure, for aero-contouring a surface 50 (see FIGS. 1C and 4A) to be aero-contoured of an aerodynamically functional coating 214 (see FIG. 8) applied to a structure 52 (see FIGS. 1C, 4A, 8). FIG. 6 is a block diagram of an embodiment of an aero-contouring system 130 incorporating an embodiment of the aero-contouring apparatus 10 of the disclosure. As used herein, "aero-contouring" means abrading, including fine abrading, smoothing and polishing, of a coated or painted surface of a structure, and in particular, a surface having an aerodynamically functional coating or paint applied to the structure, in order to remove or minimize the coating or paint edges (approximately right angle (90 degrees) steps), and to remove any surface inclusions or other particles or defects on the surface.

The aerodynamically functional coating 214 (see FIG. 8) is preferably in the form of a paint or other suitable coating. Alternatively, the aero-contouring apparatus 10 may be used for aero-contouring a surface 50 (see FIGS. 1C and 4A) of an aerodynamically functional coating 220 comprising an aerodynamically functional film element 220 (see FIG. 6), for example, an appliqué, applied to the structure 52 (see FIGS. 1C, 4A, 8). The aerodynamically functional film element 220 (see FIG. 6) may also be applied in addition to an aerodynamically functional paint on the structure 52 (see FIGS. 1C, 4A, 8).

The aerodynamically functional coating 214 (see FIG. 8) and the aerodynamically functional film element 220 (see FIG. 6) may comprise a decorative coating 216 (see FIG. 6) or a non-decorative coating 218 (see FIG. 6). Preferably, the aerodynamically functional coating 214 (see FIG. 8) and the aerodynamically functional film element 220 (see FIG. 6) comprise a decorative coating 216 (see FIG. 6), such as an airline livery design.

The surface 50 (see FIGS. 1C, 4A, 8) to be aero-contoured is preferably in the form of a coated or painted surface 50*a* (see FIGS. 1C, 3) that is coated or painted with the aerodynamically functional coating 214 (see FIG. 8) and/or the aerodynamically functional film element 220 (see FIG. 6). The coated or painted surface 50*a* preferably comprises an exterior aerodynamic surface 53 (see FIG. 8) of a structure 52 (see FIG. 8) of an air vehicle 200 (see FIG. 8), such as an aircraft 200*a* (see FIG. 8). Structures 52 (see FIG. 8) with exterior aerodynamic surfaces 53 (see FIG. 8) may comprise one or more of a tail 208 (see FIG. 8) of the air vehicle 200 (see FIG. 8), including a vertical stabilizer tail portion 210 (see FIG. 8) and horizontal stabilizer tail portions 212 (see FIG>8); wings 204 (see FIG. 8) of the air vehicle 200 (see FIG. 8), including winglets 206 (see FIG. 8); a fuselage 202 (see FIG. 8) of the air vehicle 200 (see FIG. 8); nacelles 213 (see FIG. 8) of the air vehicle 200 (see FIG. 8); or other suitable structures with exterior aerodynamic surfaces.

Preferably, the aero-contouring apparatus 10 (see FIG. 6) comprises an abrading apparatus 11 (see FIG. 6) configured for random orbit motion 132 (see FIG. 6) on the surface 50 (see FIG. 1C) to be aero-contoured, for example, a random orbit sander. As used herein, "random orbit motion" means motion or movement in repetitive circular strokes, such as simultaneously spinning and moving in an ellipse, to produce a random orbit pattern. Because the aero-contouring apparatus 10 (see FIG. 6) is preferably configured for random orbit motion 132, during operation, no abrading debris 138 (see FIG. 6) or particles travel the same path twice. This preferably results in an absence or reduction of swirl marks in the surface 50 (see FIGS. 1C, 4A, 8) of the aerodynamically functional coating 214 (see FIG. 8) after aero-contouring. Further, the aero-contouring apparatus 10 (see FIG. 6) configured for random orbit motion 132 may be used to aero-contour a large surface area more rapidly as compared to non-random orbit motion devices.

The aero-contouring apparatus 10 (see FIGS. 1A-2C, 4A-5C) preferably comprises an abrading unit 60 (see FIGS. 1A, 2A-2B, 4A), discussed in detail below, having an abrading media 64 (see FIG. 2B), such as an abrasive film and loop element 64*a* (see FIG. 2B). The abrading unit 60 (see FIG. 1A), including the abrading media 64 (see FIG. 2B), preferably both have an outer diameter 76 (see FIG. 2A) with a length in a range of from about one (1) inch to about less than three (3) inches, and more preferably, both have an outer diameter 76 with a length in a range of from about one (1) inch to about one and a quarter (1.25) inch.

FIGS. 1A-1C show one of the embodiments of the aero-contouring apparatus 10, such as in the form of an aero-contouring apparatus 10*a*, for aero-contouring a surface 50 (see FIG. 1C) to be aero-contoured of an aerodynamically functional coating 214 (see FIG. 8) applied to the structure 52 (see FIG. 1C). FIG. 1A is an illustration of a side perspective view of the embodiment of the aero-contouring apparatus 10, such as in the form of aero-contouring apparatus 10*a*, of the disclosure for aero-contouring the surface 50 (see FIG. 1C). FIG. 1B is an illustration of a top perspective view of the aero-contouring apparatus 10, such as in the form of aero-contouring apparatus 10*a*, of FIG. 1A. FIG. 1C is an illustration of a side view of the aero-contouring apparatus 10, such as in the form of aero-contouring apparatus 10*a*, of FIG. 1A showing various internal components in phantom lines.

As shown in FIGS. 1A-1C, the aero-contouring apparatus 10 comprises a housing assembly 12. The housing assembly 12 may be in the form of a closed housing assembly 12*a* (see FIGS. 1A, 2A, 2C, 5A), or the housing assembly 12 may be in the form of an open housing assembly 12*b* (see FIG. 4A). As shown in FIGS. 1A-1C, the housing assembly 12 comprises a top end 14*a*, a bottom end 14*b*, and a body portion 16 there between. As further shown in FIGS. 1A-1C, the body portion 16 may comprise a lower skirt portion 20 that flares outwardly at the bottom end 14*b* of the body portion 16 to facilitate collection of abrading debris 138 during aero-contouring of the surface 50 with the aero-contouring apparatus 10. A lip portion 18 (see FIGS. 1A-1C) may be formed in the skirt portion 20 (see FIGS. 1A-1C) at the bottom end 14*b* (see FIGS. 1A-1C).

The housing assembly 12 (see FIG. 1A) may further comprise an open interior portion 22 (see FIG. 1A) at the bottom end 14*b* (see FIG. 1A). The open interior portion 22 (see FIG. 1A) is preferably of a sufficient size and configuration to receive for installation within the housing assembly 12, at least a motor assembly 80 (see FIG. 1C), an engagement force/tilt limiting member 28 (see FIGS. 1A-1C) and an abrading unit 60 (see FIGS. 1A, 1C).

As shown in FIGS. 1A-1C, the housing assembly 12 may further comprise a grip portion 24 configured for manually holding the aero-contouring apparatus 10 during manual operation. The grip portion 24 (see FIGS. 1A-1C) may be in the form of a side extending grip portion 24*a* (see FIGS. 1A-1C, 2C), a top grip portion 24*b* (see FIGS. 2A-2B), a trigger handle grip portion 24*c* (see FIGS. 4A-5B), or another suitable grip portion 24. As shown in FIGS. 1A-1C, 4A-4B, 5A-5B, the grip portion 24 has a first end 26*a* and a second end 26*b*. The second end 26*b* (see FIGS. 1A-1C, 4A-4B, 5A-5B) is preferably integrated with the body 16 (see FIGS. 1A-1C) or coupled to the body 16 (see FIGS. 4A-4B, 5A-5B). The grip portion 24 (see FIG. 1A) and the body portion 16 (see FIG. 1A) of the housing assembly 12 (see FIG. 1A) are preferably made of a strong but flexible material, such as a strong, flexible plastic, nylon, vinyl or other suitable strong, flexible material.

As shown in FIGS. 1A-5B, the aero-contouring apparatus 10 further comprises an engagement force/tilt limiting member 28 coupled to the housing assembly 12. The engagement force/tilt limiting member 28 (see FIGS. 1A, 2A) is preferably in the form of a machined ring member 28*a* (see FIGS. 1A, 2A).

Figure 2A:
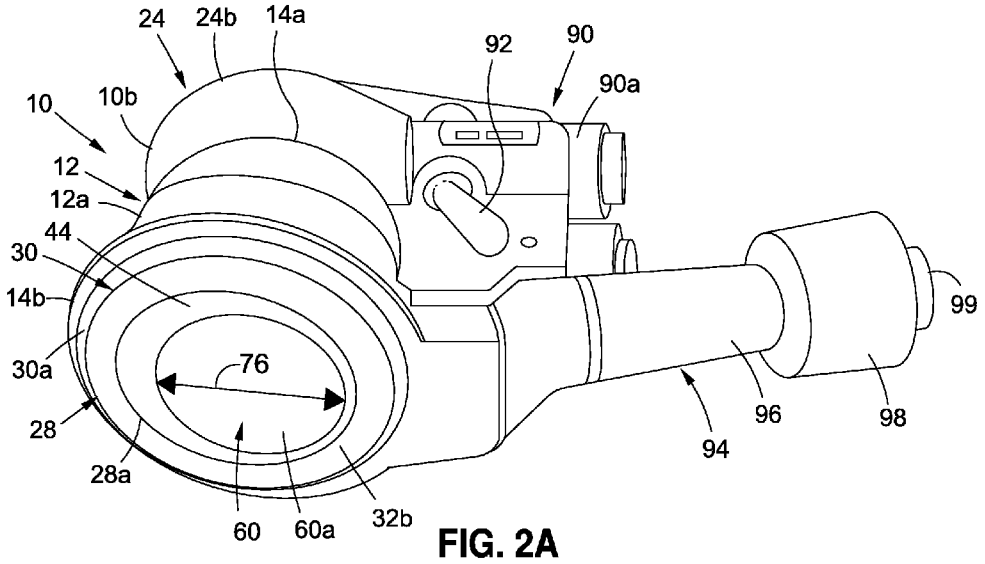
FIG. 2A is an illustration of a bottom perspective view of another embodiment of an aero-contouring apparatus of the disclosure for aero-contouring a surface.
Figure 2B:
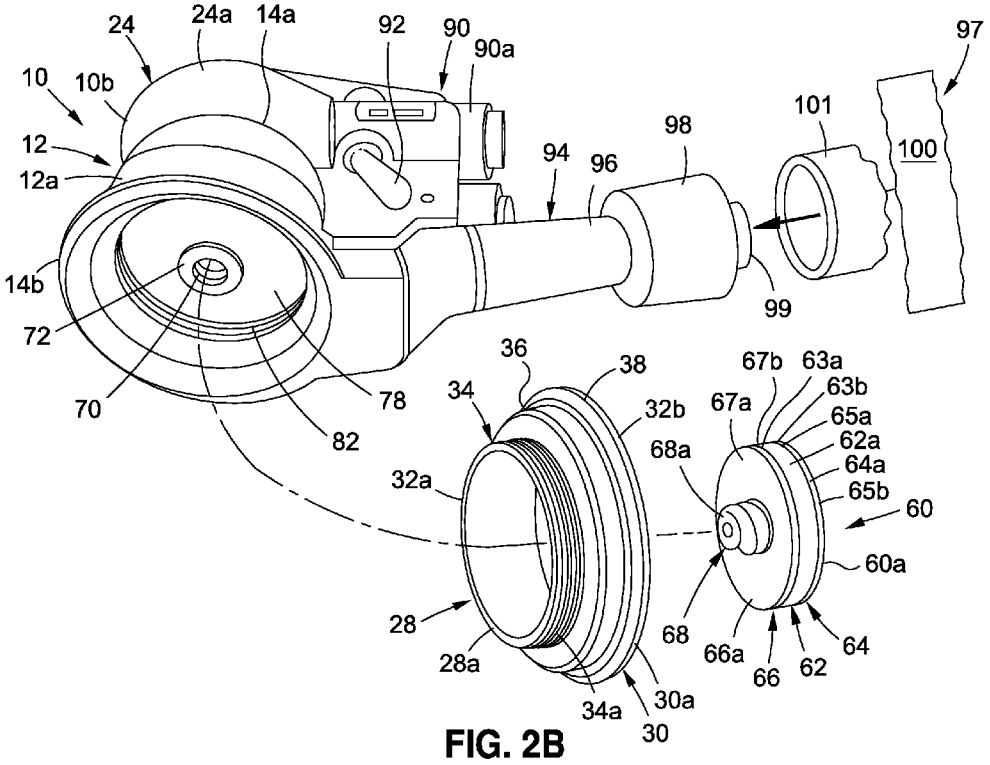
FIG. 2B is an illustration of an exploded view of the aero-contouring apparatus of FIG. 2A.
Figure 3A:
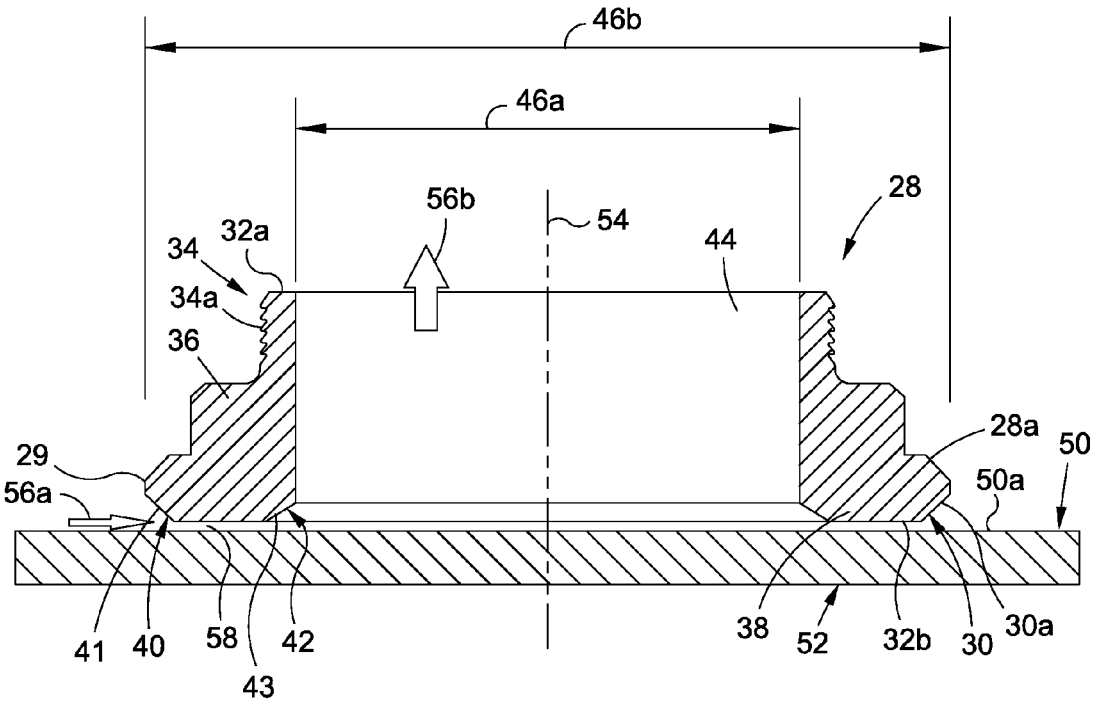
FIG. 3A is an illustration of a sectional view of an engagement force/tilt limiting member of the aero-contouring apparatus of the disclosure showing one embodiment of a non-squared edge configuration.

FIG. 3A is an illustration of a sectional view of the engagement force/tilt limiting member 28 of the aero-contouring apparatus 10 (see FIGS. 1A, 2A) of the disclosure for aero-contouring a surface 50 of a structure 52. FIG. 2B also shows a side perspective view of the engagement force/tilt limiting member 28, such as in the form of machined ring member 28*a*. As shown in FIGS. 2B and 3A, the engagement force/tilt limiting member 28, such as in the form of machined ring member 28*a*, has a first end 32*a*, a second end 32*b*, a body portion 36 there between, and a central through opening 44 (see FIGS. 1A, 3A) formed in the engagement force/tilt limiting member 28. The bottom end 32*b* (see FIG. 3A) of the engagement force/tilt limiting member 28 (see FIG. 3A) is configured to contact the surface 50 (see FIG. 3A) to be aero-contoured of the aerodynamically functional coating 214 (see FIG. 6).

As further shown in FIGS. 2B and 3A, the body portion 36 of the engagement force/tilt limiting member 28, such as in the form of machined ring member 28*a*, comprises a coupling portion 34 having a plurality of coupling elements 34*a* formed in the coupling portion 34. The coupling elements 34*a* may be in the form of snap fit coupling elements such as serrated snap fit coupling elements, or other suitable coupling elements. The coupling elements 34*a* (see FIG. 2B) are configured to couple, and preferably snap fit, with a plurality of coupling element engagement portions 82 (see FIG. 2B) formed in an interior wall 78 (see FIG. 2B) of the body portion 16 of the housing assembly 12 (see FIG. 2B). The engagement force/tilt limiting member 28, such as in the form of machined ring member 28*a*, preferably securely snaps into the interior wall 78 (see FIG. 2B) of the body portion 16 of the housing assembly 12 (see FIG. 2B) but may also be removed if desired.

As further shown in FIGS. 2B and 3A, the body portion 36 of the engagement force/tilt limiting member 28, such as in the form of machined ring member 28*a*, comprises a base portion 38 having an outer rim portion 29 (see FIG. 3A) with a non-squared edge configuration 30. As shown in FIGS. 2B and 3A, the non-squared edge configuration 30 of the outer rim portion 29 (see FIG. 3A) may comprise a beveled configuration 30*a*.

Figure 3B:
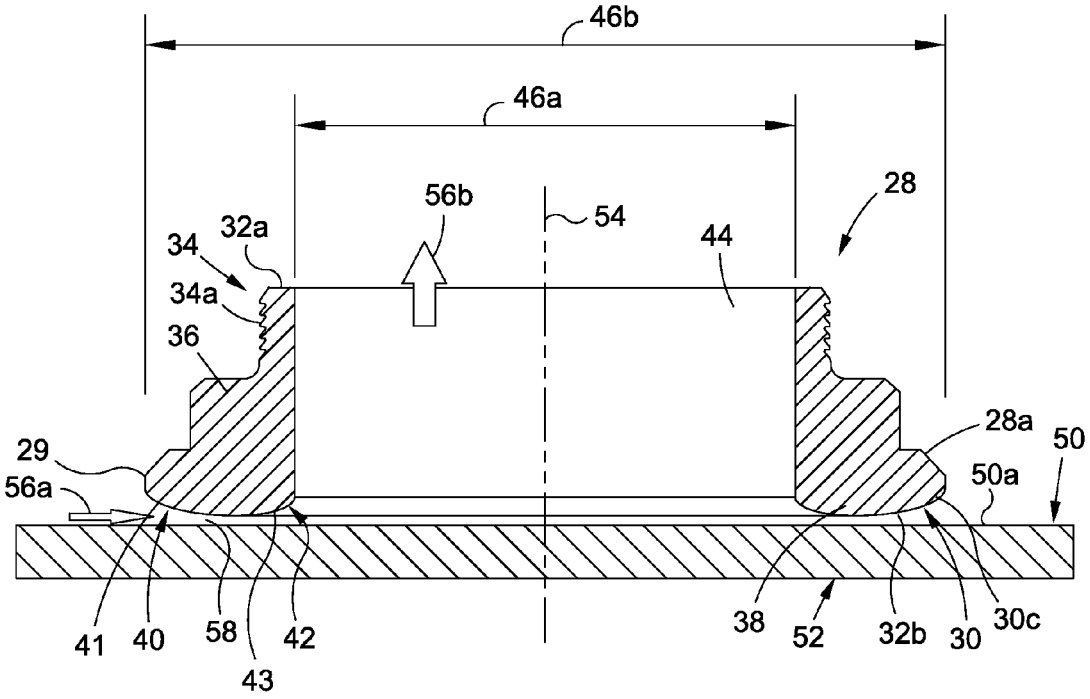
FIG. 3B is an illustration of a sectional view of an engagement force/tilt limiting member of the aero-contouring apparatus of the disclosure showing another embodiment of a non-squared edge configuration.

FIG. 3B is an illustration of a sectional view of an engagement force/tilt limiting member 28, such as in the form of machined ring member 28*a*, of the aero-contouring apparatus (see FIGS. 1A, 2A) of the disclosure showing another embodiment of a non-squared edge configuration 30. As shown in FIG. 3B, the non-squared edge configuration 30 of the outer rim portion 29 may comprise a continuous curve configuration 30*c*.

Alternatively, as shown in FIG. 4A, the non-squared edge configuration 30 of the outer rim portion 29 may comprise a radiused configuration 30*b*. The outer rim portion 29 may also have another suitable non-squared edge configuration.

As further shown in FIG. 3A, the engagement force/tilt limiting member 28, such as in the form of machined ring member 28*a*, has an inner diameter 46*a* equal to the diameter of the central through opening 44, and has in outer diameter 46*b* equal to the outermost diameter of the outer rim portion 29. FIG. 3A further shows a centerline 54 running through the center of the central through opening 44.

Figure 2C:
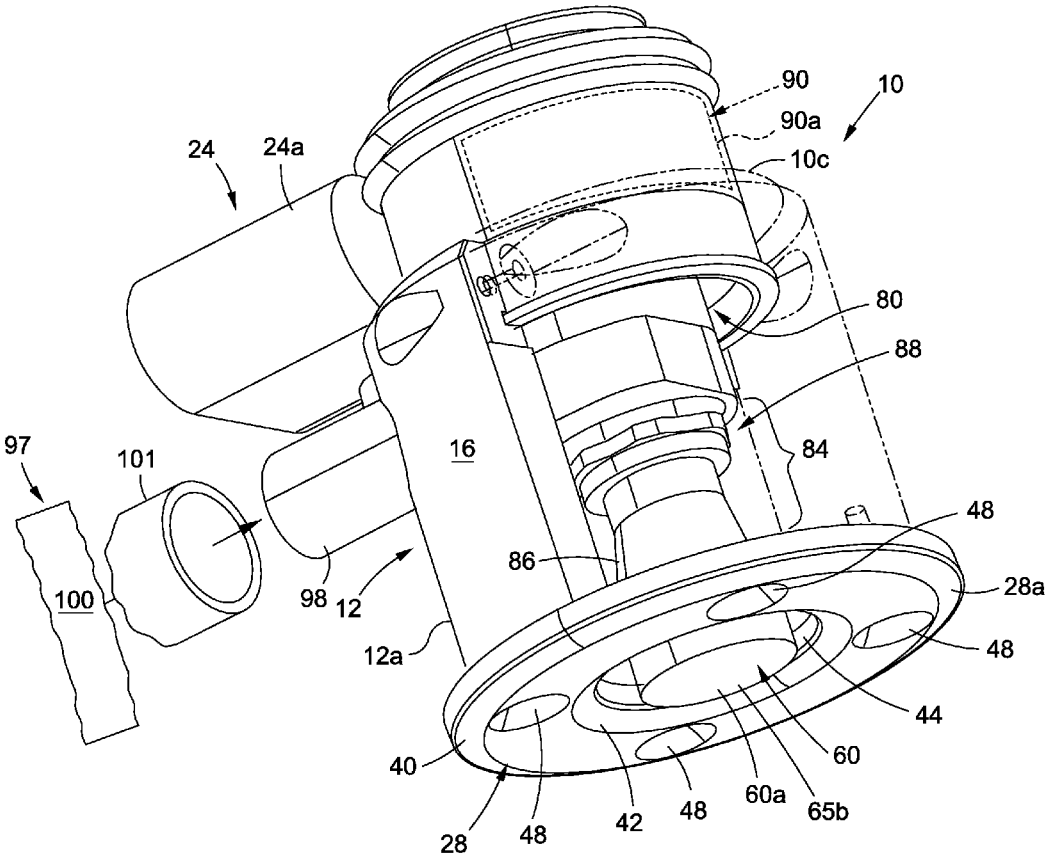
FIG. 2C is an illustration of a side perspective view of yet another embodiment an aero-contouring apparatus of the disclosure for aero-contouring a surface.

In one embodiment as shown in FIG. 2A, the bottom end 32*b* of the engagement force/tilt limiting member 28, such as in the form of machined ring member 28*a*, is flat or substantially flat with the only opening being the central through opening 44. In another embodiment as shown in FIGS. 2C and 4C, the bottom end 32*b* of the engagement force/tilt limiting member 28, such as in the form of machined ring member 28*a*, has a plurality of countersink openings 48. As shown in FIGS. 2C and 4E, the countersink openings 48 may be spaced an equidistance apart from each other. As shown in FIG. 4E, each of the countersink openings 48 is configured to receive a countersink element 108.

As further shown in FIGS. 1A and 3A-3B, the engagement force/tilt limiting member 28, such as in the form of machined ring member 28*a*, comprises a converging nozzle portion 40 and a diverging nozzle portion 42. As shown in FIGS. 3A-3B, the converging nozzle portion 40 has a first tapered portion 41, that preferably tapers inwardly and downwardly from the outermost portion of the outer rim portion 29 to the bottom end 32*b* of the engagement force/tilt limiting member 28. As shown in FIGS. 3A-3B, the diverging nozzle portion 42 has a second tapered portion 43, that preferably tapers outwardly and upwardly from the bottom end 32*b* of the engagement force/tilt limiting member 28 toward the central through opening 44. The geometry of the converging nozzle portion 40 and the diverging nozzle portion 42 effectively produces a convergent-divergent nozzle at the surface 50 (see FIGS. 3A-3B) being aero-contoured or abraded. This convergent-divergent nozzle comprises the first tapered portion 41 (see FIGS. 3A-3B) and the second tapered portion 43 (see FIGS. 3A-3B) and accelerate the supplied suction driven air flow velocity 56*a* (see FIGS. 3A-3B) at the surface 50 being aero-contoured or abraded. This, in turn, may improve collection of the abrading debris 138 (see FIG. 6) by the developed geometry of the convergent-divergent nozzle feature.

Figure 5A:
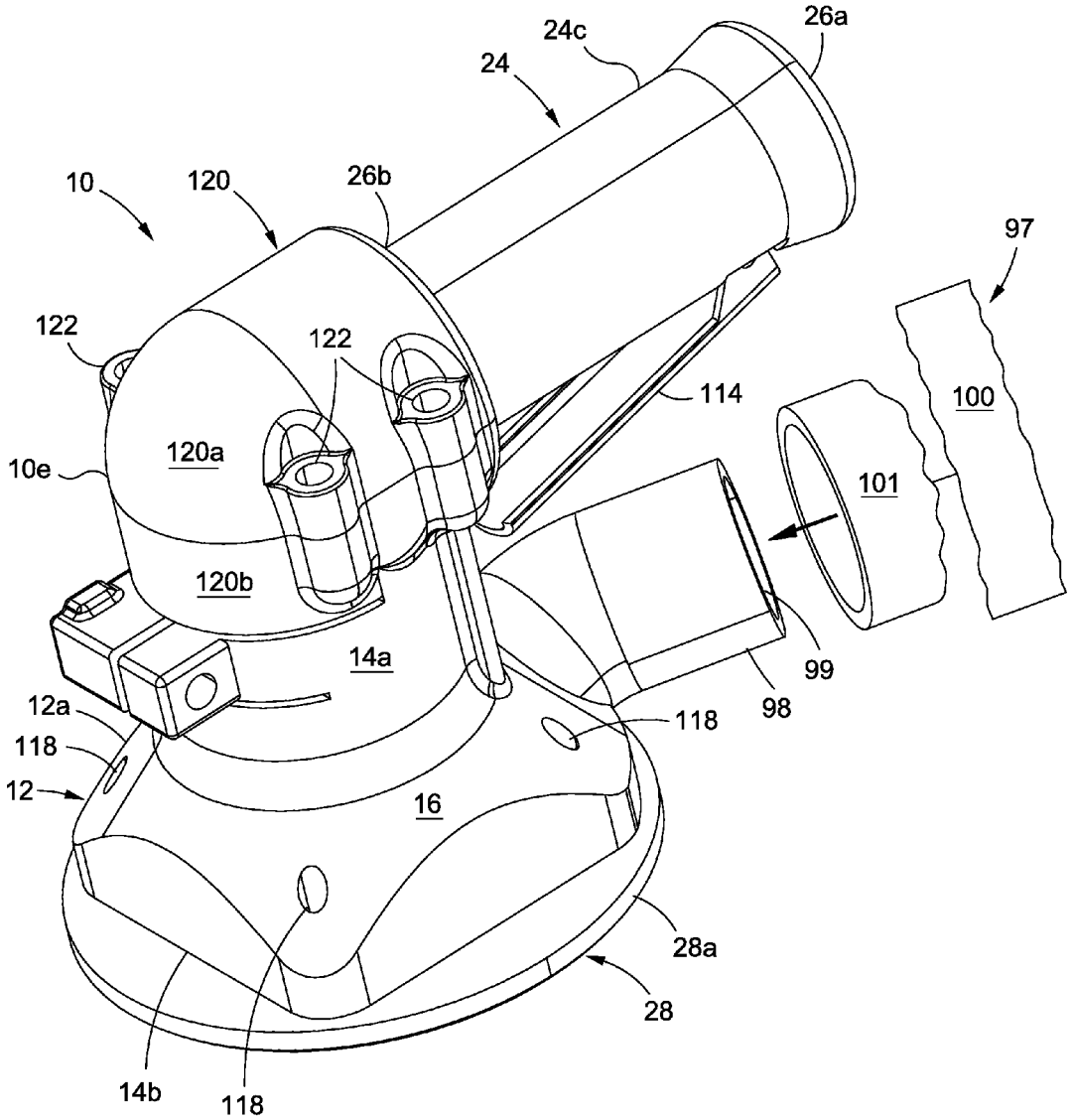
FIG. 5A is an illustration of a back perspective view of yet another embodiment of an aero-contouring apparatus of the disclosure for aero-contouring a surface.
Figure 6:
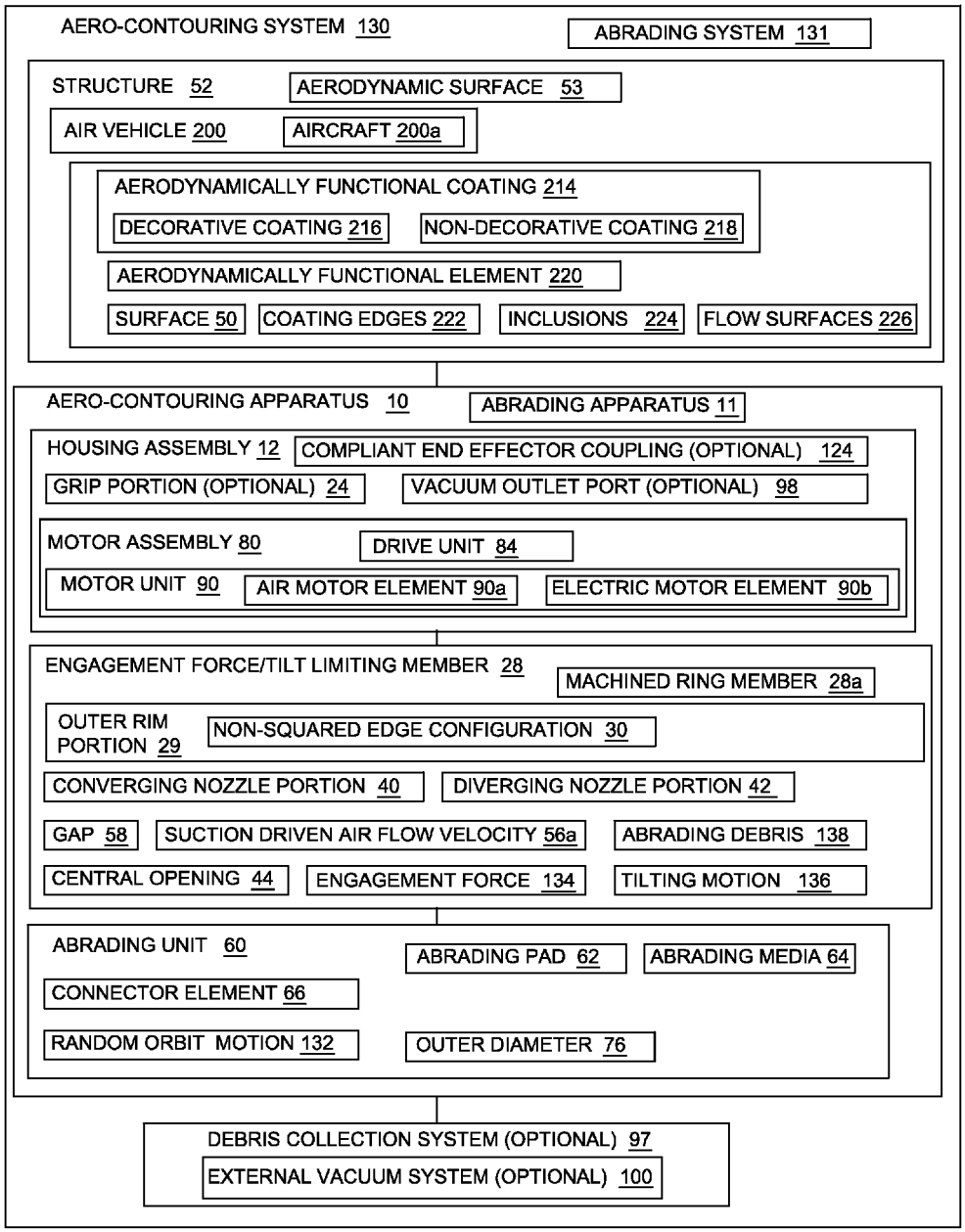
FIG. 6 is a block diagram of an embodiment of an aero-contouring system of the disclosure.

When the aero-contouring apparatus 10 is configured for use with a debris collection system 97 (see FIGS. 2B, 5A), such as an external vacuum system 100 (see FIGS. 2B, 5A), the converging nozzle portion 40 (see FIGS. 3A-3B) and the diverging nozzle portion 42 (see FIGS. 3A-3B) together preferably accelerate a suction driven air flow velocity 56*a* (see FIG. 3A) flowing within a gap 58 at the surface 50 (see FIGS. 3A-3B) to entrain abrading debris 138 (see FIG. 6) for collection in the debris collection system 97 (see FIGS. 2B, 5A), such as external vacuum system 100 (see FIGS. 2B, 5A).

As shown in FIGS. 3A-3B, the gap 58 between the bottom end 32*b* of the engagement force/tilt limiting member 28, such as in the form of machined ring member 28*a*, and the surface 50, such as the coated or painted surface 50*a*, is very narrow. The converging nozzle portion 40 (see FIGS. 3A-3B) and the diverging nozzle portion 42 (see FIGS. 3A-3B) preferably accelerate the suction driven air flow velocity 56*a* (see FIGS. 3A-3B) within the gap 58 (see FIGS. 3A-3B) and draw up a suction drawn air flow velocity 56*b* (see FIGS. 3A-3B) through the central opening 44 (see FIGS. 3A-3B). High velocity air flow within the gap 58 entrains, or draws in and transports, any abrading debris 138 (see FIG. 6) or sanding debris for collection in the debris collection system 97 (see FIGS. 2B, 5A), such as the external vacuum system 100 (see FIGS. 2B, 5A) connected to the aero-contouring apparatus 10 (see FIGS. 2B, 5A). Thus, the aero-contouring apparatus 10 provides a confined flow path to collect abrading debris 138 (see FIG. 6) for any aero-contouring apparatus 10 configured for use with a debris collection system 97 (see FIG. 2B), such as an external vacuum system 100 (see FIG. 2B).

The engagement force/tilt limiting member 28, such as in the form of machined ring member 28*a*, is preferably made of a material that prevents or minimizes transfer of any contaminant material or residue material from the engagement force/tilt limiting member 28 (see FIGS. 3A-3B) to the surface 50 (see FIGS. 3A-3B) to be aero-contoured. The engagement force/tilt limiting member 28, such as in the form of machined ring member 28*a*, is preferably constructed of a material, such as a strong and stiff acetal resin material, a strong and stiff nylon material, or another suitably strong and stiff plastic material, that prevents or minimizes transfer of any contaminant material or residue material from the engagement force/tilt limiting member 28 (see FIGS. 3A-3B) to the surface 50 (see FIGS. 3A-3B), such as the coated or painted surface 50*a* (see FIGS. 3A-3B) to be aero-contoured. More preferably, the engagement force/tilt limiting member 28, such as in the form of machined ring member 28*a*, is made of DELRIN acetal resin. (DELRIN is a registered trademark of E.I. Du Pont de Nemours and Company of Wilmington, Del.)

In addition to the engagement force/tilt limiting member 28, such as in the form of machined ring member 28*a*, any other parts of the aero-contouring apparatus 10 that may directly contact the surface 50 (see FIGS. 3A-3B), such as a coated or painted surface 50*a* (see FIGS. 3A-3B), are also preferably made of a material that prevents or minimizes transfer of any contaminant material or residue material from the engagement force/tilt limiting member 28 (see FIGS. 3A-3B) to the surface 50 (see FIGS. 3A-3B) to be aero-contoured.

As shown in FIGS. 1C and 2C, the aero-contouring apparatus 10 further comprises a motor assembly 80 disposed within the housing assembly 12. As further shown in FIGS.

1C and 2C, the motor assembly 80 comprises a motor unit 90 and a drive unit 84. The motor unit 90 (see FIGS. 1C, 2C) may comprise an air motor element 90*a* (see FIG. 1C, 2C). Alternatively, the motor unit 90 may comprise an electric motor element 90*b* (see FIG. 6) or another suitable motor unit.

As further shown in FIGS. 1C and 2C, the drive unit 84 has a first end 85*a* and a second end 85*b*. At the first end 85*a* (see FIG. 1C) is an abrading unit engagement portion 86 (see FIGS. 1C, 2C). At the first end 85*b* (see FIG. 1C) is a motor unit engagement portion 88 (see FIGS. 1C, 2C). The drive unit 84 may preferably comprise a rotary drive shaft adaptor unit or another suitable drive mechanism. The drive unit 84 (see FIG. 1C) is preferably configured to drive or rotate an abrading unit 60 (see FIG. 1C), such as in the form of a sanding unit 60*a* (see FIG. 1C). The abrading unit engagement portion 86 (see FIG. 1C) is preferably attached to the abrading unit 60 (see FIG. 1C). The motor unit engagement portion 88 (see FIG. 1C) is preferably attached to the motor unit 90 (see FIG. 1C).

As shown in FIGS. 1A-2C, 4A-5C, the aero-contouring apparatus 10 further comprises the abrading unit 60 (see FIG. 1C) coupled to the drive unit 84 (see FIG. 1C) and inserted through the central opening 44 (see FIG. 2C) in non-contact communication with the engagement force/tilt limiting member 28 (see FIG. 2C), such as in the form of machined ring member 28*a* (see FIG. 2C). The abrading unit 60 (see FIG. 2C) is preferably attached to the abrading unit engagement portion 86 (see FIGS. 1C, 2C) driven by the drive unit 84 (see FIGS. 1C, 2C) in a random orbit motion 132 (see FIG. 6) on the surface 50 (see FIG. 1C).

The random orbit motion 132 may produce a random orbit abrading or sanding pattern by simultaneously spinning the abrading unit 60 and moving the abrading unit 60 in an ellipse. As shown in FIG. 1A, the abrading unit 60, such as in the form of sanding unit 60*a*, is preferably in an offset position 74 as compared to the engagement force/tilt limiting member 28 and as compared to the housing assembly 12 of the aero-contouring apparatus 10.

As shown in FIGS. 2B, 2C, the abrading unit 60, such as in the form of sanding unit 60*a* (see FIG. 2C), comprises an abrading pad 62, an abrading media 64 attached to one side of the abrading pad 62, and a connector element 66 attached to the other side of the abrading pad 62. As shown in FIG. 2B, the abrading pad 62 has a first side 63*a* and a second side 63*b*. The abrading pad 62 (see FIG. 2B) may preferably be in the form of a foam pad and hook element 62*a* (see FIG. 2B). For example, the foam pad and hook element 62*a* may comprise a foam pad layer on the first side 63*a* and a hook layer on the second side 63*b*. The hook layer may be attached to the foam pad layer with an adhesive material.

As further shown in FIG. 2B, the connector element 66 has a first side 67*a* and a second side 67*b*. The connector element 66 (see FIG. 2B) may preferably be in the form of a twist lock connector 66*a* having a locking element 68, such as in the form of a twist lock element 68*a*. The locking member 68 is preferably attached to the first side 67*a* of the connector element 66 and configured for connection to the drive unit 84 (see FIGS. 1C, 2C). As shown in FIG. 2B, the first side 63*a* of the abrading pad 62 is preferably attached to the second side 67*b* of the connector element 66 with an adhesive material. As further shown in FIG. 2B, the locking member 68 of the connector element 66 is preferably configured for insertion through an opening 70 and is configured for attachment to a connector element receiving element 72 positioned in the housing assembly 12.

As shown in FIG. 2B, the abrading media 64 has a first side 65*a* and a second side 65*b*. The first side 65*a* (see FIG. 2B) of the abrading media 64 is preferably attached to the second side 63*b* (see FIG. 2B) of the abrading pad 62 (see FIG. 2B). The abrading media 64 (see FIG. 2B) may preferably be in the form of an abrasive film and loop element 64*a* (see FIG. 2B). For example, the abrasive film and loop element 64*a* (see FIG. 2B) may comprise a loop layer on the first side 65*a* and an abrasive sanding film or sanding paper on the second side 65*b*. The abrasive sanding film or sanding paper of the abrading media 64 (see FIG. 2B) preferably has a grit size sufficient for finish quality requirements. The abrading media 64 is designed to be a consumable item that is consumed or used up after one or more uses and may be replaced.

As shown in FIG. 2A, the abrading unit 60, including the abrading pad 62 (see FIG. 2B), the abrading media 64 (see FIG. 2B), the connector element 66 (see FIG. 2A), preferably has an outer diameter 76 with a length in a range of from about one (1) inch to about less than three (3) inches, and more preferably, has an outer diameter 76 with a length in a range of from about one (1) inch to about one and a quarter (1.25) inch. The aero-contouring apparatus 10, such as in the form of abrading apparatus 11 (see FIG. 6), preferably has sufficient clearance to permit a random orbit motion 132 (see FIG. 6) of the abrading unit 60 (see FIG. 2B), such as in the form of a one and a quarter (1.25) inch diameter abrading unit 60.

The aero-contouring apparatus 10, such as in the form of abrading apparatus 11 (see FIG. 6), preferably uses an abrading media 64 (see FIG. 2B), such as in the form of abrasive film and loop element 64*a* (see FIG. 2B), that is one and a quarter (1.25) inch diameter or slightly smaller in diameter to limit the aero-contoured or abraded area to that immediately near a coating edge 222 (see FIG. 6) or surface inclusion 224 (see FIG. 6) defect, making the aero-contouring process more controllable, and reducing the area with a visual difference between aero-contoured and non-aero-contoured areas after the aero-contouring. The aero-contouring apparatus 10 preferably maintains the second side 65*b* (see FIG. 1A) of the abrading unit 60 (see FIGS. 1A, 1C) almost flush with the surface 50 (see FIG. 1C), such as the coated or painted surface 50*a* (see FIG. 1C), to facilitate control of the aero-contouring apparatus 10, from tilting more than a few degrees and abrading or sanding through the aerodynamically functional coating 214 (see FIG. 6).

As shown in FIGS. 1A-2C and FIGS. 4A-5C, the housing assembly 12, the motor assembly 80, the engagement force/tilt limiting member 28, and the abrading unit 60, together comprise an aero-contouring apparatus 10 for aero-contouring the surface 50 to be aero-contoured. The engagement force/tilt limiting member 28 (see FIG. 6) mechanically limits both an engagement force 134 (see FIG. 6) and any tilting motion 136 (see FIG. 6) of the abrading unit 60 (see FIG. 6) with respect to the surface 50 (see FIG. 6). In particular, the engagement force/tilt limiting member 28 (see FIG. 6) mechanically limits the engagement force of the abrading unit 60 (see FIG. 2B), and in particular, the abrading media 64 (see FIG. 2B), with a surface 50 to be aero-contoured.

In addition, the engagement force/tilt limiting member 28 (see FIG. 6) mechanically limits any tilting of the abrading unit 60, and in particular, the abrading pad 62 (see FIG. 2B) and the abrading media 64 (see FIG. 2B), with respect to the surface 50 (see FIGS. 1C, 4A) to prevent excessive sanding pressure on one side of the sanding unit 60, such as abrading pad 62 or the abrading media 64, which may result in gouging of the surface 50. The aero-contouring apparatus 10 with the engagement force/tilt limiting member 28 (see FIG. 6) is preferably designed to keep the abrading media 64 (see FIG. 2B) in parallel or tangential contact with the surface 50 which may be flat or curved, that is to be aero-contoured or abraded.

In another embodiment, the aero-contouring apparatus 10, such as in the form of abrading apparatus 11 (see FIG. 6), comprises a debris collection system 97 (see FIG. 2B), such as an external vacuum system 100 (see FIG. 2B), for removing any abrading debris 138 (see FIG. 6). As shown in FIGS. 2A-2C, the aero-contouring apparatus 10 may be in the form of an aero-contouring apparatus 10*b*, having a vacuum outlet port 98 configured for attachment to a vacuum attachment element 101 (see FIG. 2) connected to a debris collection system 97 (see FIG. 2B), such as an external vacuum system 100 (see FIG. 2B).

FIG. 2A is an illustration of a bottom perspective view of the embodiment of the aero-contouring apparatus 10, such as in the form of aero-contouring apparatus 10*b*, for aero-contouring the surface 50 (see FIGS. 1C, 4A, 8). The aero-contouring apparatus 10 is used with a debris collection system 97 (see FIG. 2B), such as an external vacuum system 100 (see FIG. 2B). FIG. 2B is an illustration of an exploded view of the aero-contouring apparatus 10, such as in the form of aero-contouring apparatus 10*b*, of FIG. 2A, showing the engagement force/tilt limiting member 28 and the abrading unit 60 separated from the housing assembly 12 of the aero-contouring apparatus 10 (see FIG. 2B).

As shown in FIGS. 2A-2B, the aero-contouring apparatus 10 comprises the housing assembly 12, such as in the form of closed housing assembly 12*a*, having a top end 14*a*, a bottom end 14*b*, and a grip portion 24, such as in the form of top grip portion 24*b*. As further shown in FIGS. 2A-2B, the aero-contouring apparatus 10 comprises the engagement force/tilt limiting member 28 having a non-squared edge configuration 30, such as comprising a radiused configuration 30*a*, and the abrading unit 60 inserted through the central through opening 44 (see FIG. 2A).

As further shown in FIGS. 2A-2B, the aero-contouring apparatus 10 comprises a limiting valve 92 attached to the motor unit 90, such as an air motor element 90*a*. The limiting valve 92 preferably comprises an air motor exhaust restrictor, for example, an air motor variable exhaust restrictor that regulates the revolutions per minute (rpms) of the drive unit 84 which drives or rotates the attached abrading unit 60.

As further shown in FIGS. 2A-2B, the aero-contouring apparatus 10 comprises an exhaust assembly 94 having an exhaust tube portion 96, a vacuum outlet port 98 with an attachment end 99. As shown in FIG. 2B, the attachment end 99 of the vacuum outlet port 98 is preferably configured for attachment with the vacuum attachment element 101 of the debris collection system 97, such as the external vacuum system 100.

FIG. 2C is an illustration of another embodiment of the aero-contouring apparatus 10, such as in the form of aero-contouring apparatus 10*c*, comprising another version of the engagement force/tilt limiting member 28 and another version of the housing assembly 12. As shown in FIG. 2C, the engagement force/tilt limiting member 28 has the plurality of countersink openings 48, and the housing assembly 12 is preferably in the form of a closed housing assembly 12*a*. In addition, FIG. 2C shows the aero-contouring apparatus 10*c* comprising a vacuum outlet port 98 configured for attachment to a vacuum attachment element 101 of a debris collection system 97, such as an external vacuum system 100.

Figure 4B:
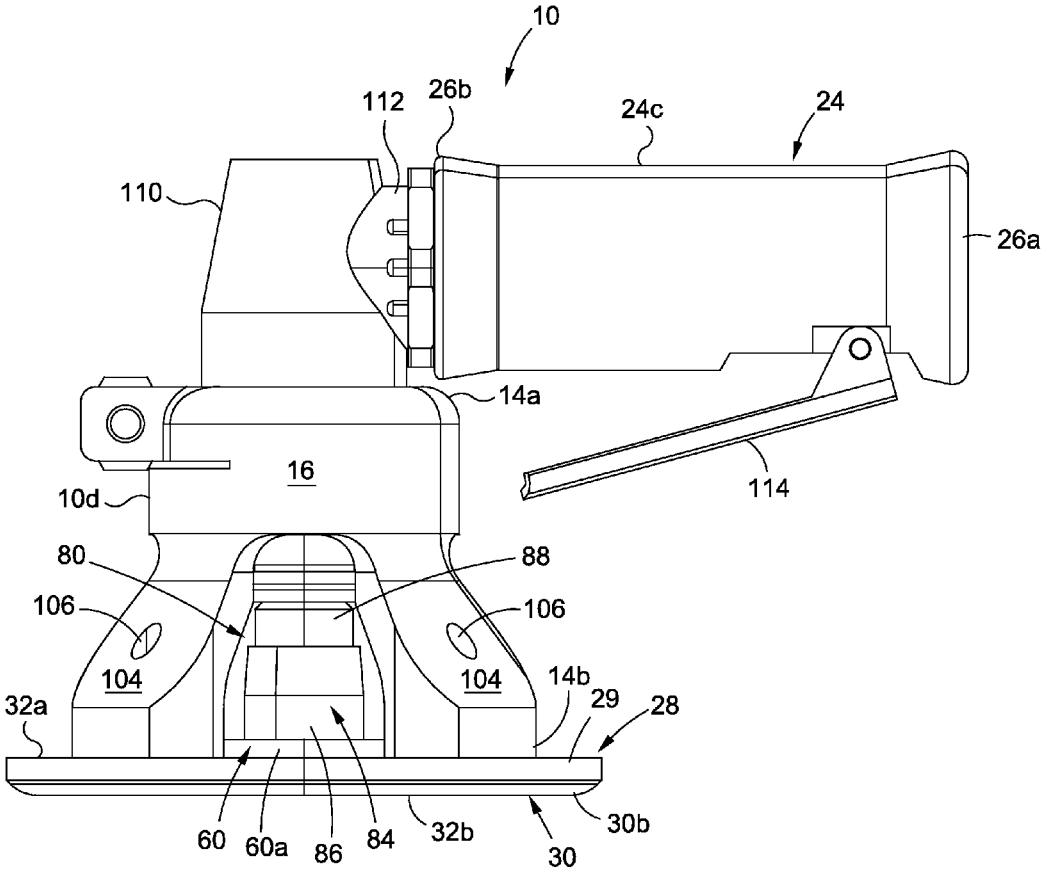
FIG. 4B is an illustration of a side view of the aero-contouring apparatus of FIG. 4A.
Figure 4C:
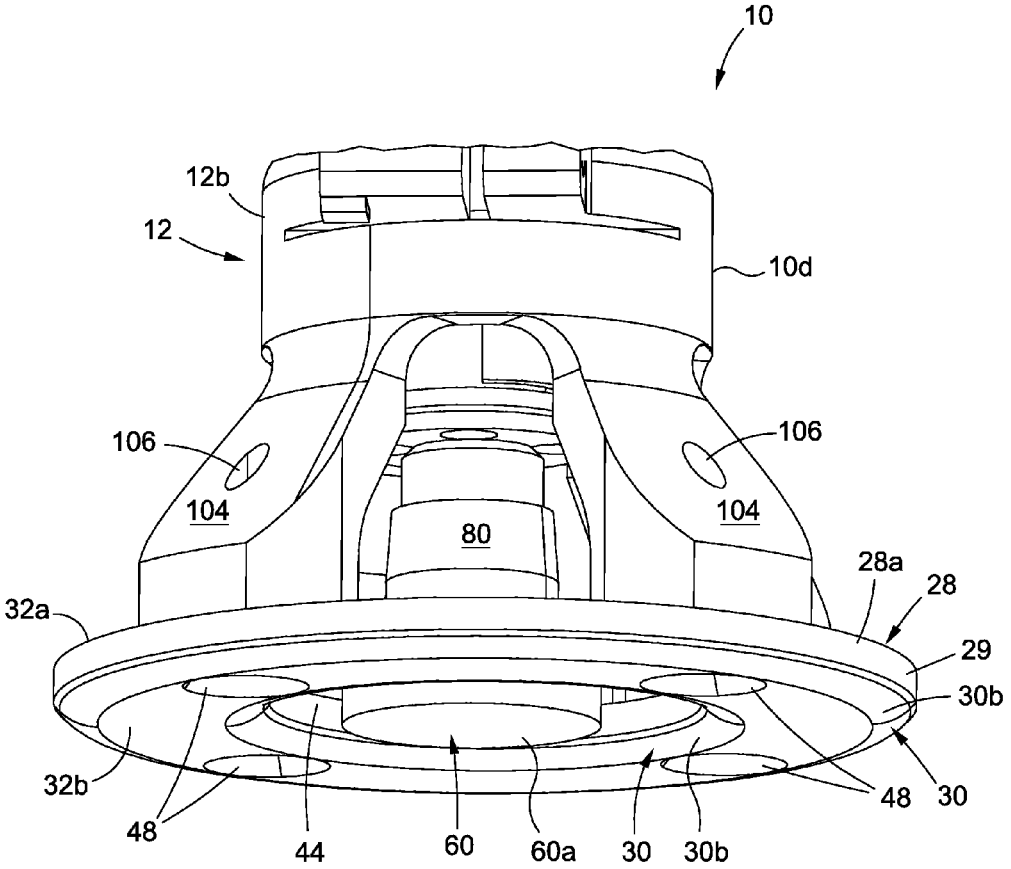
FIG. 4C is an illustration of a front view of the aero-contouring apparatus of FIG. 4A.
Figure 4D:
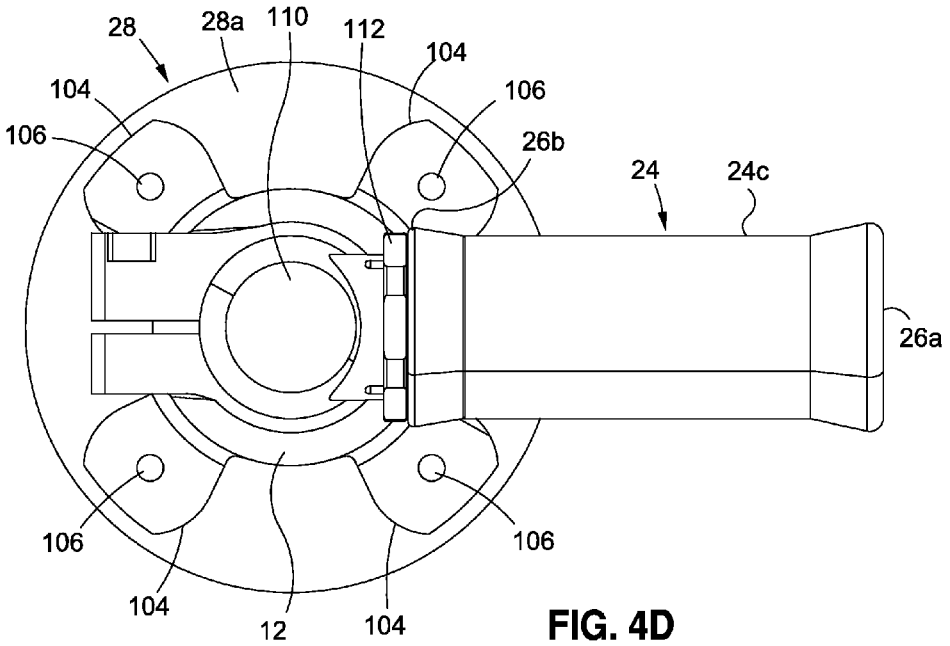
FIG. 4D is an illustration of a top plan view of the aero-contouring apparatus of FIG. 4A.
Figure 4E:
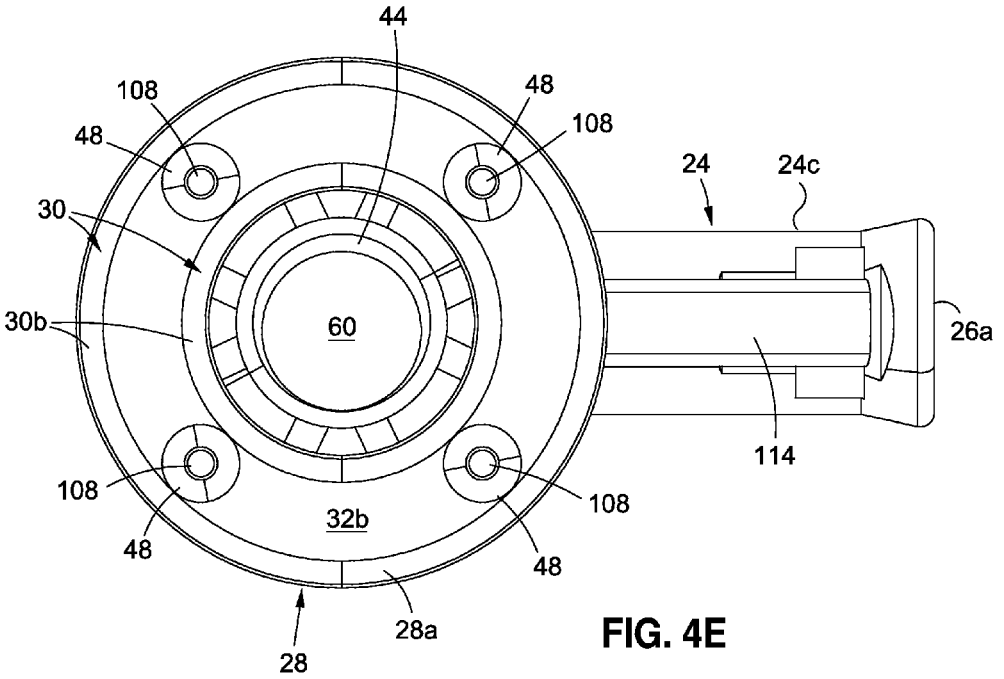
FIG. 4E is an illustration of a bottom plan view of the aero-contouring apparatus of FIG. 4A.

In one embodiment as shown in FIGS. 4A-4E, the aero-contouring apparatus 10 may be configured for performing touch-up aero-contouring, for example, of small surface areas. FIG. 4A is an illustration of a front perspective view of another embodiment of an aero-contouring apparatus 10, such as in the form of aero-contouring apparatus 10*d*, of the disclosure for aero-contouring a surface 50 of a structure 52. The aero-contouring apparatus 10*d* of FIGS. 4A-4E is preferably configured for touch-up applications of the surface 50 of the structure 52. FIG. 4B is an illustration of a side view of the aero-contouring apparatus 10, such as in the form of aero-contouring apparatus 10*d*, of FIG. 4A.

FIG. 4C is an illustration of a front view of the aero-contouring apparatus 10, such as in the form of aero-contouring apparatus 10*d*, of FIG. 4A. FIG. 4D is an illustration of a top plan view of the aero-contouring apparatus 10, such as in the form of aero-contouring apparatus 10*d*, of FIG. 4A. FIG. 4E is an illustration of a bottom plan view of the aero-contouring apparatus o 10*d* f FIG. 4A.

As shown in FIG. 4A, in this embodiment, the housing assembly 12 comprises one or more cut-out portions 102 forming a viewing feature 103 enabling an operator to view an aero-contouring location 105 on the surface 50 of the structure 52 to be aero-contoured during touch-up aero-contouring with the aero-contouring apparatus 10. For spot touch-up, the aero-contouring apparatus 103, shown in FIGS. 4A-4E provides a way of easily locate and view the aero-contouring location 105 to be aero-contoured or abraded while providing the prior mechanical limiting feature to prevent excessive sanding or gouging.

As further shown in FIG. 4A, the housing assembly 12 is in the form of an open housing assembly 12*b* having leg portions 104 with openings 106 for receiving countersink elements 108 (see FIG. 4E). In addition, as shown in FIG. 4A, the housing assembly 12 may comprise a grip portion 24, such as in the form of a trigger handle grip portion 24*c*, that extends from the top end 14*a* of the housing assembly 12. The trigger handle grip portion 24*c* comprises a first end 26*a*, a second end 26*b*, and a trigger handle portion 114 (see FIG. 4A). The trigger handle grip portion 24*c* houses the motor unit 90, and the second end 26*b* of the trigger handle grip portion 24*c* is attached to the housing assembly 12. As further shown in FIG. 4A, the housing assembly 12 comprises a right angle gear box 110 and exhaust ports 112.

As shown in FIG. 4B, the aero-contouring apparatus 10, such as in the form of aero-contouring apparatus 10*d*, comprises the engagement force/tilt limiting member 28 having an outer rim portion 29 with a non-squared edge configuration 30. The non-squared edge configuration 30 may comprise the radiused configuration 30*b* (see FIG. 4B). Further, as shown in FIG. 4B, the aero-contouring apparatus 10, such as in the form of aero-contouring apparatus 10*d*, comprises the motor assembly 80 comprising the drive unit 84, the abrading unit engagement portion 86, and the motor unit engagement portion 88.

As shown in FIG. 4E, the aero-contouring apparatus 10, such as in the form of aero-contouring apparatus 10*d*, comprises the engagement force/tilt limiting member 28, such as in the form of machined ring member 28*a*. The engagement force/tilt limiting member 28, such as in the form of machined ring member 28*a*, preferably has on the bottom end 32*b*, the plurality of countersink openings 48 having countersink elements 108, and an outer rim portion 29 with a non-squared edge configuration 30, such as comprising a radiused configuration 30*b*.

FIG. 5A is an illustration of a back perspective view of another embodiment of an aero-contouring apparatus 10, such as in the form of aero-contouring apparatus 10*e*, where the aero-contouring apparatus 10 may be used with a clamp fixture 120, for aero-contouring a surface 50. As shown in FIG. 5A, the aero-contouring apparatus 10*e* with the clamp fixture 120 is preferably configured for use with a debris collection system 97, such as an external vacuum system 100 and configured for attachment to the vacuum attachment element 101 of the debris collection system 97, such as the external vacuum system 100.

Figure 5B:
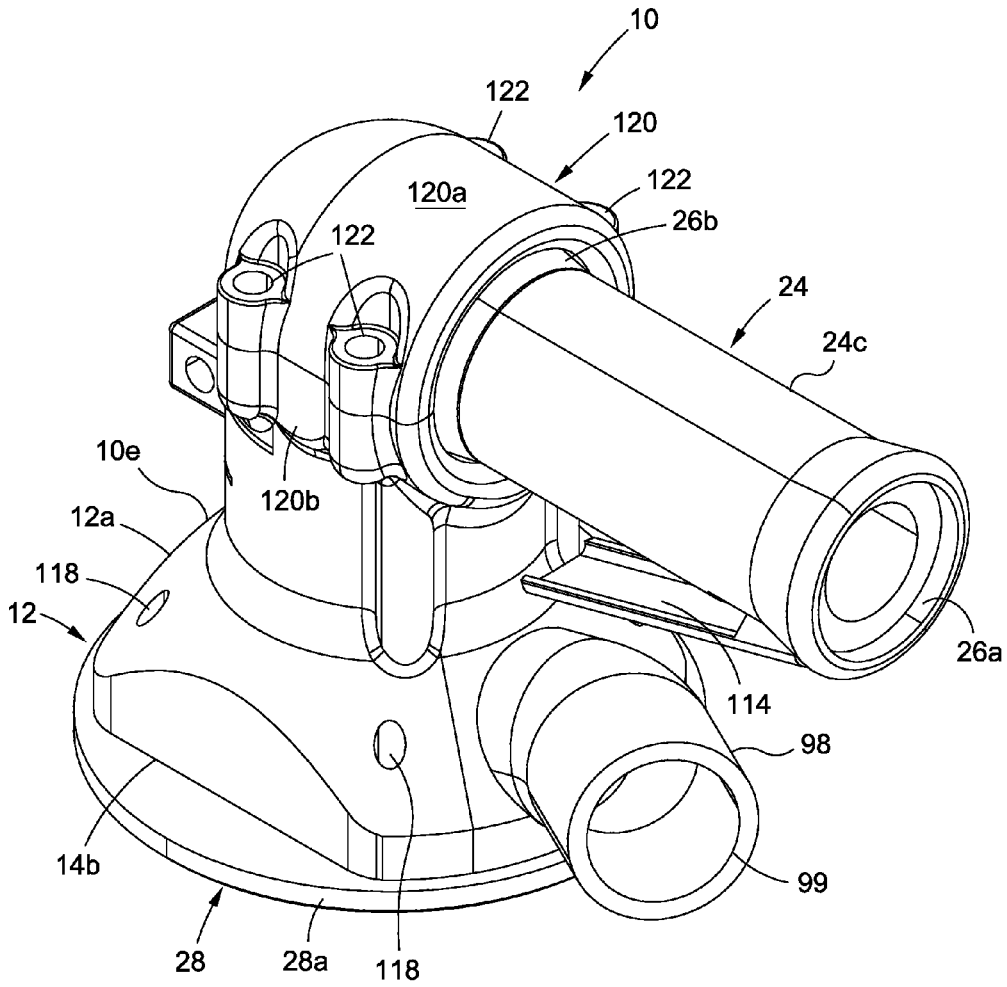
FIG. 5B is an illustration of a front perspective view of the aero-contouring apparatus of FIG. 5A.

FIG. 5B is an illustration of a front perspective view of the aero-contouring apparatus 10, such as in the form of aero-contouring apparatus 10*e*, of FIG. 5A. As shown in FIGS. 5A-5B, the clamp fixture 120 comprises a first portion 120*a* attached to a second portion 120*b* via attachment portions 122. The clamp fixture 120 may be an extension of the top end 14*a* of the housing assembly 12. As further shown in FIGS. 5A-5B, the housing assembly 12 is a substantially closed housing assembly 12, with openings 118 for receiving attachment elements (not shown) to enable attachment to the engagement force/tilt limiting member 28, such as in the form of machined ring member 28*a*. As shown in FIGS. 5A-5B, the engagement force/tilt limiting member 28 comprises a machined ring member 28*a* with a non-squared edge configuration 30, such as comprising a radiused configuration 30*b*.

As further shown in FIGS. 5A-5B, the housing assembly 12 comprises a grip portion 24, such as in the form of trigger handle grip portion 24*c*, having a first end 26*a*, a second end 26*b*, and a trigger portion 114. As further shown in FIGS. 5A-5B, the housing assembly 12 comprises a vacuum outlet port 98 having an attachment end 99 configured for attachment to the vacuum attachment element 101 (see FIG. 5A) of the debris collection system 97 (see FIG. 5A), such as the external vacuum system 100 (see FIG. 5A).

The aero-contouring apparatus 10 (see FIGS. 1A, 2A, 4A, 5A) may be used not only for manual applications but for automated applications, for example, robotic applications. If the aero-contouring apparatus 10 (see FIGS. 1A, 2A, 4A, 5A) is used for automated applications, for example, robotic applications, a compliant end effector coupling 124 (see FIG. 5C) may be attached to the housing assembly 12 or integrally formed in the housing assembly 12.

Figure 5C:
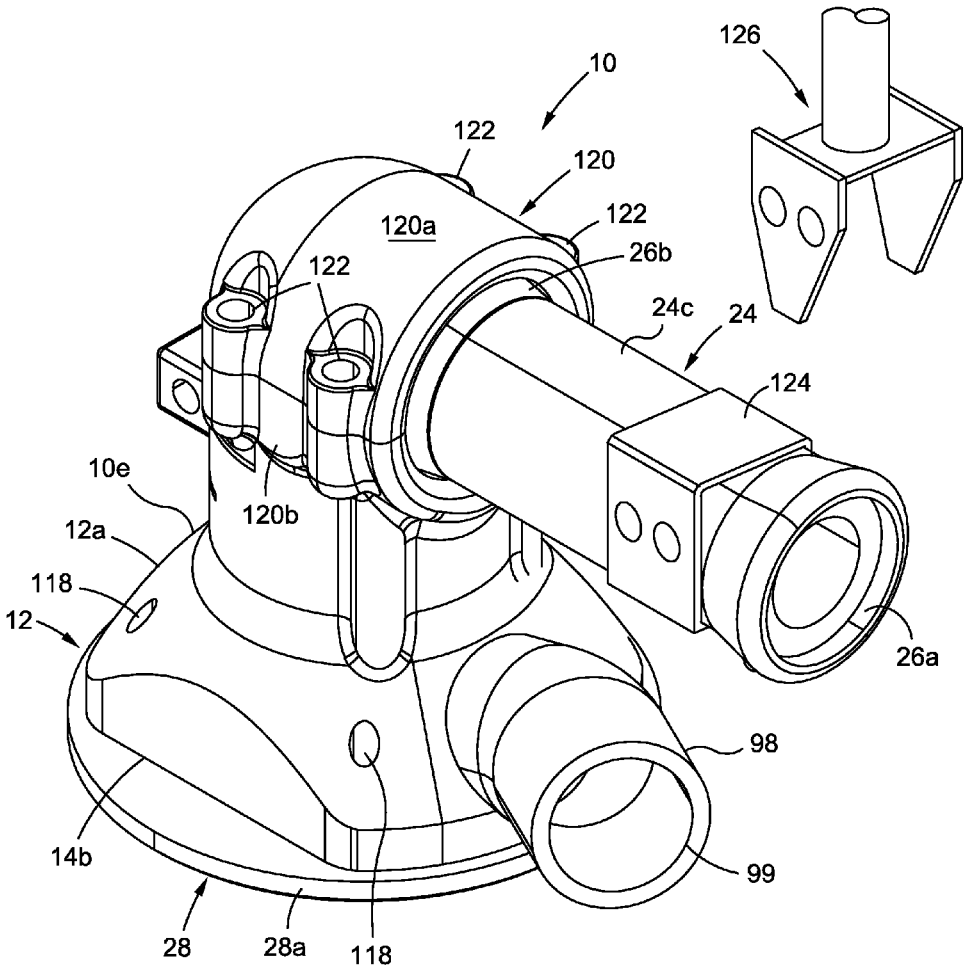
FIG. 5C is an illustration of a front perspective view of the aero-contouring apparatus of FIG. 5B with a compliant end effector coupling for robotic applications.

FIG. 5C is an illustration of a front perspective view of the aero-contouring apparatus 10, such as in the form of aero-contouring apparatus 10*e*, of FIG. 5B, that may be used for automated applications such as robotic applications. The compliant end effector coupling 124 (see FIG. 5C) is preferably configured for attachment to a robotic device 126 (see FIG. 5C). The trigger portion 114 (see FIG. 5B) may be removed from the aero-contouring apparatus 10*e* (see FIG. 5C) and replaced with the compliant end effector coupling 124 (see FIG. 5C), as the robotic device 126 is designed to hold or grip the grip portion 24 via the compliant end effector coupling 124 (see FIG. 5C).

In another embodiment of the disclosure, there is provided an aero-contouring system 130. FIG. 6 is a block diagram of an embodiment of an aero-contouring system 130 incorporating an embodiment of the aero-contouring apparatus 10 of the disclosure. Preferably, the aero-contouring system 130 (see FIG. 6) comprises an abrading system 131 (see FIG. 6), for example, a sanding and polishing system.

The aero-contouring system 130 comprises a structure 52 coated with an aerodynamically functional coating 214 having a surface 50 to be aero-contoured. The structure 52 comprises one or more of a tail 208 of an air vehicle 200, including a vertical stabilizer tail portion 210 and horizontal stabilizer tail portions 212; wings of an air vehicle 200, including winglets 206; fuselage 202 of an air vehicle 200; and nacelles 213 of an air vehicle 200. The structure 52 may be coated with an aerodynamically functional coating 214 comprising an aerodynamically functional film element 220.

As shown in FIG. 6, the aero-contouring system 130 further comprises an aero-contouring apparatus 10 for aero-contouring the surface 50. The aero-contouring apparatus 10 comprises a housing assembly 12 and a motor assembly 80 disposed within the housing assembly 12. The motor assembly 80 comprises a motor unit 90 and a drive unit 84.

As shown in FIG. 6, the aero-contouring apparatus 10 of the aero-contouring system 130 further comprises an engagement force/tilt limiting member 28 coupled to the housing assembly 12. The engagement force/tilt limiting member 28 has a central opening 44 and has a bottom end 32*b* (see FIGS. 3A-3B) configured to contact a surface 50 to be aero-contoured of an aerodynamically functional coating 214 applied to a structure 52.

As shown in FIG. 6, the engagement force/tilt limiting member 28 comprises a converging nozzle portion 40 and a diverging nozzle portion 42 that together accelerate a suction driven air flow velocity 56*a* at the surface 50 to be aero-contoured to entrain abrading debris 138 for collection in the debris collection system 97 (see also FIGS. 2B, 2C, 5A), such as the external vacuum system 100 (see also FIGS. 2B, 2C, 5A).

As shown in FIG. 6, the aero-contouring apparatus 10 of the aero-contouring system 130 further comprises an abrading unit 60 coupled to the drive unit 84 and inserted through the central opening 44 in non-contact communication with the engagement force/tilt limiting member 28. The abrading unit 60 (see FIG. 1C) is driven by the drive unit 84 (see FIG. 1C) in a random orbit motion 132 (see FIG. 6) on the surface 50. The engagement force/tilt limiting member 28 (see FIG. 6) mechanically limits both an engagement force 134 (see FIG. 6) and any tilting motion 136 (see FIG. 6) of the abrading unit 60 (see FIG. 6) with respect to the surface 50 (see FIG. 6). Optionally, the aero-contouring system 130 may comprise a debris collection system 97, such as an external vacuum system 100 (see FIG. 6), for attachment to the aero-contouring apparatus 10, where the aero-contouring apparatus 10 further comprises a vacuum outlet port 98 (see FIG. 6).

As shown in FIG. 4A, the aero-contouring apparatus 10 may be configured for performing touch-up aero-contouring of the surface 50. As shown in FIG. 4A, the housing assembly 12 comprises one or more cut-out portions 102 forming a viewing feature 103 enabling an operator to view an aero-contouring location 105 on the surface 50 during touch-up aero-contouring with the aero-contouring apparatus 10.

Figure 7:
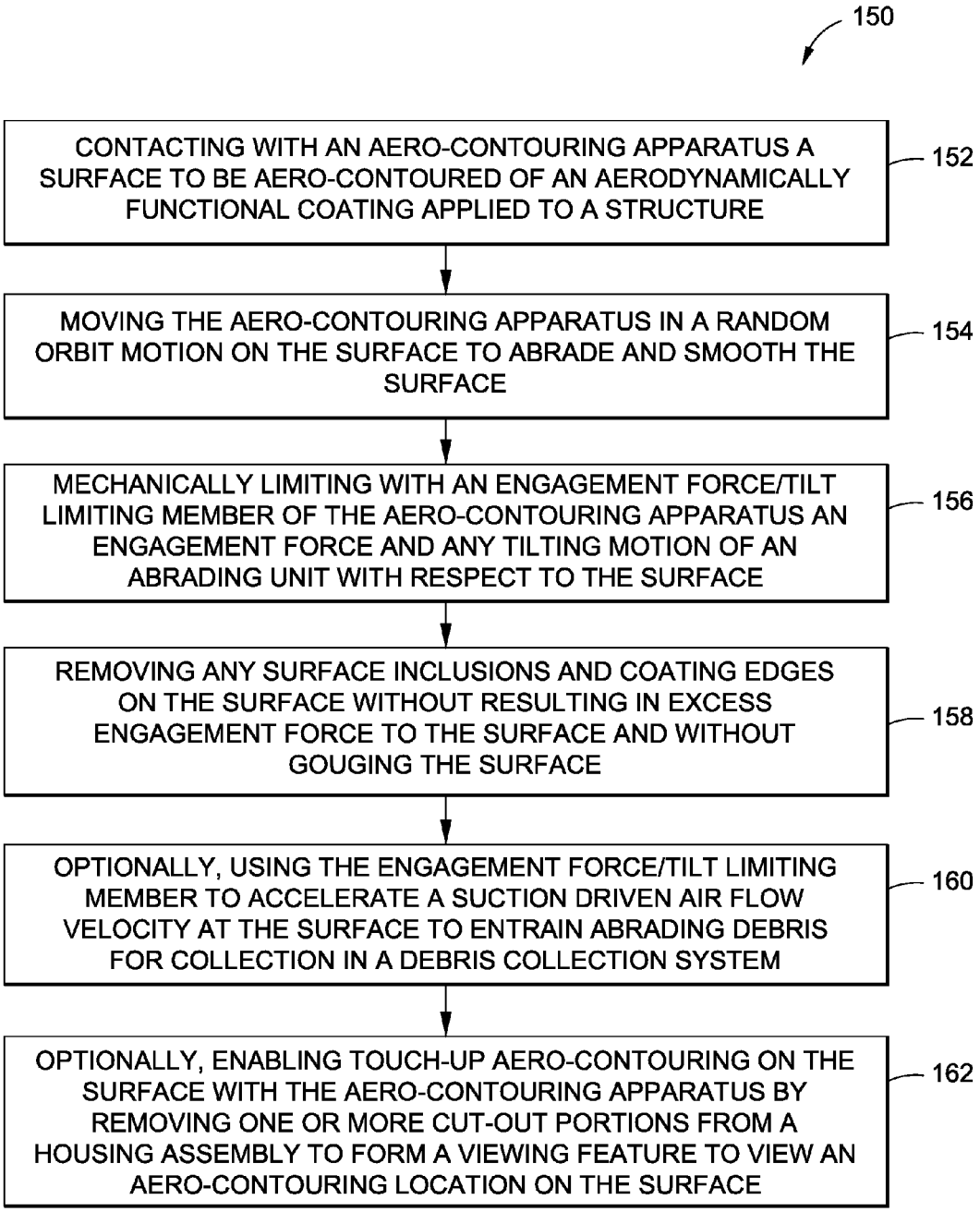
FIG. 7 is a flow diagram of an aero-contouring method of the disclosure.

In another embodiment of the disclosure, there is provided a method 150 of aero-contouring a surface 50 of an aerodynamically functional coating 214 applied to a structure 52. FIG. 7 is a flow diagram of an aero-contouring method 150 of the disclosure. The method 150 of aero-contouring may be performed manually or may be automated. The method 150 comprises step 152 of contacting with an aero-contouring apparatus 10 (see FIGS. 1A-2C, 4A-5C) a surface 50 to be aero-contoured of an aerodynamically functional coating 214 (see FIG. 8) applied to a structure 52.

As shown in FIGS. 1A-2C, 4A-5C, the aero-contouring apparatus 10 comprises a housing assembly 12 and a motor assembly 90 disposed within the housing assembly 12. As shown in FIGS. 1A-2C, 4A-5C, the motor assembly comprises a motor unit and a drive unit 84. As shown in FIGS. 1A-2C, 4A-5C, the aero-contouring apparatus 10 further comprises an engagement force/tilt limiting member 28 coupled to the housing assembly 12. The engagement force/tilt limiting member 28 has a central opening 44. The aero-contouring apparatus 10 further comprises an abrading unit 60 coupled to the drive unit 84 and inserted through the central opening 44 in non-contact communication with the engagement force/tilt limiting member 28.

As shown in FIG. 7, the step 152 of contacting the surface 50 with the aero-contouring apparatus 10 preferably comprises contacting the surface 50 (see FIGS. 1C, 4A) with an abrading unit 60 (see FIGS. 1C, 4A) of the aero-contouring apparatus 10 (see FIGS. 1C, 4A), where the abrading unit 60 has an outer diameter 76 (see FIG. 2A) with a length in a range of from about 1 inch to about 1.25 inch. The step 152 of contacting the surface 50 (see FIGS. 1A, 4A) further comprises forming the engagement force/tilt limiting member 28 (see FIGS. 1A, 4A) of a material that prevents or minimizes transfer of any contaminant material or residue material from the engagement force/tilt limiting member 128 to the surface 50 to be aero-contoured.

As shown in FIG. 7, the method 150 further comprises step 154 of moving the aero-contouring apparatus 10 (see FIGS. 1A-2C, 4A-5C) in a random orbit motion 132 (see FIG. 6) on the surface 50 (see FIGS. 1C, 4A) to abrade and smooth the surface 50 (see FIGS. 1C, 4A). In particular, the abrading unit 60 (see FIG. 2B) of the aero-contouring apparatus 10 (see FIGS. 1A-2C, 4A-5C) may be moved in a random orbit motion 132 (see FIG. 6) on the surface 50 (see FIGS. 1C, 4A) to abrade and smooth the surface 50 (see FIGS. 1C, 4A).

Abrading and smoothing the surface 50 (see FIGS. 1C, 4A) of the aerodynamically function coating 214, and/or the aerodynamically functional element 220, preferably comprise using the aero-contouring apparatus 10 (see FIGS. 1A-2B, 4A-5B), such as in the form of abrading apparatus 11 (see FIG. 11), to abrade and smooth coating edges 222 (see FIG. 6), such as paint edges and flow surfaces 226 (see FIG. 6). In addition, abrading and smoothing the surface 50 (see FIGS. 1C, 4A) of the aerodynamically functional coating 214, and/or the aerodynamically functional element 220, preferably comprise using the aero-contouring apparatus 10 (see FIGS. 1A-2B, 4A-5C), such as in the form of abrading apparatus 11 (see FIG. 11), to perform fine abrasion such as completely abrading the coating edges 222 (see FIG. 6), such as paint edges, and flow surfaces 226 (see FIG. 6) in order to blend the appearance of the surface 50 that has been aero-contoured and any non-aero-contoured surfaces.

As shown in FIG. 7, the method 150 further comprises step 156 of mechanically limiting with the engagement force/tilt limiting member 28 (see FIGS. 2A, 4A) an engagement force 134 (see FIG. 6) and any tilting motion 136 (see FIG. 6) of the abrading unit 60 (see FIG. 6) with respect to the surface 50 (see FIGS. 1C, 3, 4A).

As shown in FIG. 7, the method 150 further comprises step 158 of removing or minimizing any surface inclusions 224 (see FIG. 6) and coating edges 222 (see FIG. 6) on the surface 50 (see FIG. 6) without causing excessive engagement force 134 (see FIG. 6) to the surface 50 and without gouging of the surface 50 (see FIG. 6). Surface inclusions 224 (see FIG. 6) may comprise dust particles, debris particles, dry coating overspray, lint, or other particles or contaminants that may be present on the surface 50 (see FIGS. 1C, 4A) during or after aero-contouring of the surface 50 (see FIGS. 1C, 4A) with the aero-contouring apparatus 10 (see FIGS. 1A-2C, 4A-5C). Three-dimensional surface discontinuities that may occur from such surface inclusions 224 (see FIG. 6) may be even lower than coating edges 222, such as in the form of right angle (90 degrees) steps. Abrading debris 138 (see FIG. 6) may be removed with a debris collection system 97 (see FIGS. 2B-2C), such as an external vacuum system 100 (see FIGS. 2B-2C), that may be attached to the aero-contouring apparatus 10 (see FIGS. 2B-2C).

As shown in FIG. 7, the method 150 may further comprise optional step 160 of using the engagement force/tilt limiting member 28 (see FIGS. 2B, 3) to accelerate the suction driven air flow velocity 56*a* (see FIG. 6) at the surface 50 to entrain abrading debris 138 (see FIG. 6) for collection in the debris collection system 97 (see FIGS. 2B, 2C, 5A), such as the external vacuum system 100 (see FIGS. 2B, 2C, 5A). The step 160 of using the engagement force/tilt limiting member 28 (see FIGS. 3, 6) to accelerate the suction driven air flow velocity 56*a* (see FIG. 6) comprises using a converging nozzle portion 40 (see FIG. 6) and a diverging nozzle portion 42 (see FIG. 6) formed on the engagement force/tilt limiting member 28 (see FIG. 6) to accelerate the suction driven air flow velocity 56*a* (see FIG. 6).

As shown in FIG. 7, the method 150 may further comprise optional step 162 of enabling touch-up aero-contouring on the surface 50 with the aero-contouring apparatus 10 (see FIG. 4A) by removing one or more cut-out portions 102 (see FIG. 4A) from the housing assembly 12 (see FIG. 4A) to form a viewing feature 103 (see FIG. 4A) to view an aero-contouring location 105 (see FIG. 4A) on the surface 50 (see FIG. 4A) of the structure 52 (see FIG. 4A).

FIG. 8 is a perspective view of an air vehicle 200, such as in the form of an aircraft 200*a*, that may incorporate one or more surfaces 50 of a structure 52, such as exterior aerodynamic surfaces 53, of a structure 52, where the one or more surfaces 50 may be aero-contoured with one or more embodiments of the aero-contouring apparatus 10 of the disclosure. As shown in FIG. 8, the air vehicle 200, such as in the form of aircraft 200*a*, comprises a fuselage 202, wings 204, winglets 206, a tail 208 comprising a vertical tail portion 210 and horizontal tail portions 212, and nacelles 213.

Although the aircraft 200*a* shown in FIG. 8 is generally representative of a commercial passenger aircraft having one or more structures 52 that may be coated with an aerodynamically functional coating 214, such as in the form of a decorative coating 216 (see FIG. 6) or a non-decorative coating 218 (see FIG. 6), the teachings of the disclosed embodiments may be applied to other passenger aircraft. For example, the teachings of the disclosed embodiments may be applied to cargo aircraft, military aircraft, rotorcraft, and other types of aircraft or aerial vehicles, as well as aerospace vehicles, satellites, space launch vehicles, rockets, and other aerospace vehicles, that use decorative coatings 216 or non-decorative coatings 218.

Figure 9:
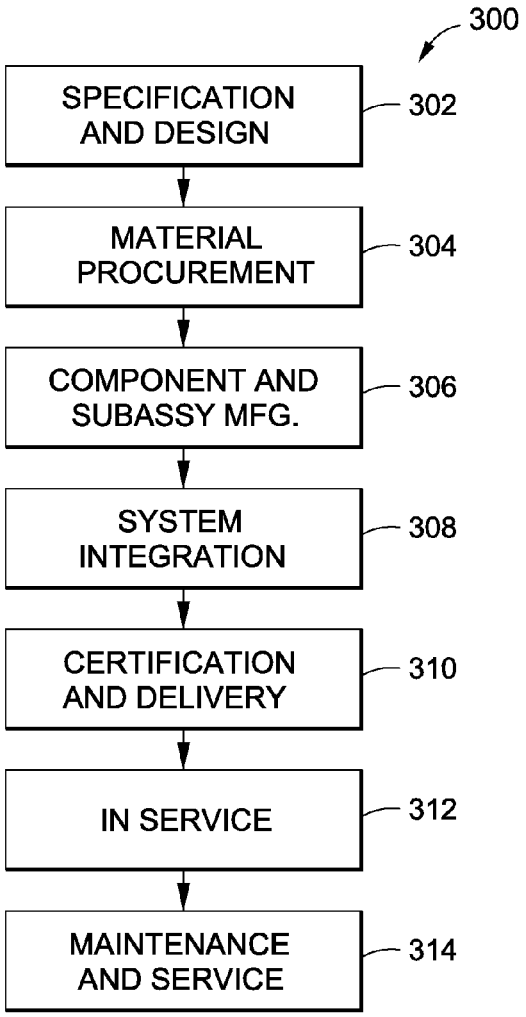
FIG. 9 is a flow diagram of an aircraft manufacturing and service method; and, FIG. 10 is a block diagram of an aircraft.
Figure 10:
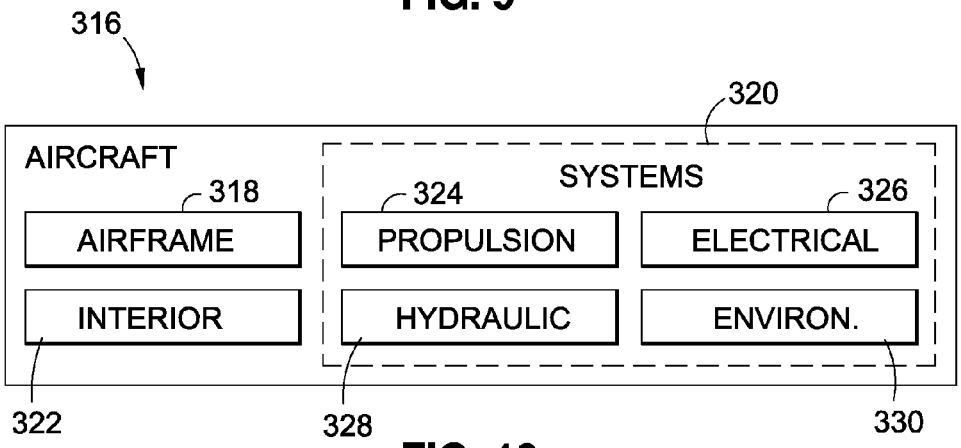

FIG. 9 is a flow diagram of an aircraft manufacturing and service method 300. FIG. 10 is a block diagram of an embodiment of an aircraft 316. Referring to FIGS. 9-10, embodiments of the disclosure may be described in the context of the aircraft manufacturing and service method 300 as shown in FIG. 9, and the aircraft 316 as shown in FIG. 10.

During pre-production, exemplary aircraft manufacturing and service method 300 may include specification and design 302 of the aircraft 316 and material procurement 304. During manufacturing, component and subassembly manufacturing 306 and system integration 308 of the aircraft 316 takes place. Thereafter, the aircraft 316 may go through certification and delivery 310 in order to be placed in service 312. While in service 312 by a customer, the aircraft 316 may be scheduled for routine maintenance and service 314 (which may also include modification, reconfiguration, refurbishment, and other suitable services).

Each of the processes of the aircraft manufacturing and service method 300 may be performed or carried out by a system integrator, a third party, and/or an operator (e.g., a customer). For the purposes of this description, a system integrator may include, without limitation, any number of aircraft manufacturers and major-system subcontractors. A third party may include, without limitation, any number of vendors, subcontractors, and suppliers. An operator may include an airline, leasing company, military entity, service organization, and other suitable operators.

As shown in FIG. 10, the aircraft 316 produced by the exemplary aircraft manufacturing and service method 300 may include an airframe 318 with a plurality of systems 320 and an interior 322. Examples of the plurality of systems 322 may include one or more of a propulsion system 324, an electrical system 326, a hydraulic system 328, and an environmental system 330. Any number of other systems may be included. Although an aerospace example is shown, the principles of the disclosure may be applied to other industries, such as the automotive industry.

Methods and systems embodied herein may be employed during any one or more of the stages of the aircraft manufacturing and service method 300. For example, components or subassemblies corresponding to component and subassembly manufacturing 306 may be fabricated or manufactured in a manner similar to components or subassemblies produced while the aircraft 316 is in service 312. Also, one or more apparatus embodiments, method embodiments, or a combination thereof, may be utilized during component and subassembly manufacturing 306 and system integration 308, for example, by substantially expediting assembly of or reducing the cost of the aircraft 316. Similarly, one or more of apparatus embodiments, method embodiments, or a combination thereof, may be utilized while the aircraft 316 is in service 312, for example and without limitation, to maintenance and service 314.

Disclosed embodiments of the aero-contouring apparatus 10 (see FIGS. 1A-2C, 4A-5C), the aero-contouring system 130 (see FIG. 6), and the method 150 (see FIG. 7) for aero-contouring have numerous advantages and provide for the aero-contouring of aerodynamically functional coatings 214 (see FIG. 6), such as decorative coatings 216 (see FIG. 6), that meet the aerodynamic requirements to retain desired flow characteristics, while also preserving decorative appearance. Disclosed embodiments of the aero-contouring apparatus 10 (see FIGS. 1A-2C, 4A-5C), the aero-contouring system 130 (see FIG. 6), and the method 150 (see FIG. 7) for aero-contouring may be used to aero-contour not only decorative coatings 216 (see FIG. 6) on exterior aerodynamic surfaces 53 (see FIG. 8) of aircraft 200*a* (see FIG. 8), such as winglets 206 (see FIG. 8) or the vertical stabilizer tail portion 210 (see FIG. 8) where smooth coating or paint edges are desired to retain desired flow characteristics, but may also be used on non-decorative coatings 218 (see FIG. 6), such as may be applied to wings 204 (see FIG. 8) and horizontal stabilizer tail portions 212(see FIG. 8), where there may be a need for removal or repair of surface inclusions 224 (see FIG. 6).

In addition, disclosed embodiments of the aero-contouring apparatus 10 (see FIGS. 1A-2C, 4A-5C), the aero-contouring system 130 (see FIG. 6), and the method 150 (see FIG. 7) for aero-contouring use an abrading unit 60 (see FIG. 2B) with an abrading media 64 (see FIG. 2B) having an outer diameter 76 (see FIG. 2A) having a length of preferably 1.25 inch or slightly smaller to limit the aero-contoured area to that immediately near the coating edge 222 (see FIG. 6) or surface inclusion 224 (see FIG. 6) defect, making the aero-contouring process more controllable, and reducing the area with a visual difference between aero-contoured and non-aero-contoured areas after the aero-contouring process.

Moreover, disclosed embodiments of the aero-contouring apparatus 10 (see FIGS. 1A-2C, 4A-5C), the aero-contouring system 130 (see FIG. 6), and the method 150 (see FIG. 7) for aero-contouring mechanically limit the engagement force 134 (see FIG. 6) of the abrading unit 60 (see FIGS. 1C, 2B) with the surface 50 (see FIG. 1C) to be aero-contoured, mechanically limit tilting of the abrading unit 60 (see FIGS. 1C, 2B) with respect to the surface 50 (see FIG. 1C) to prevent excessive aero-contouring pressure on one side of the abrading unit 60, which may result in gouging the surface 50, provide a confined flow path to collect abrading debris 138 (see FIG. 6) for vacuum equipped aero-contouring apparatuses 10, and provide for spot touch-ups of the surface 50 (see FIG. 4A) by enabling a way of easily locating and viewing the location area 105 (see FIG. 4A) to be aero-contoured while providing the prior mechanical limiting feature to prevent excessive aero-contouring or gouging.

Further, disclosed embodiments of the aero-contouring apparatus 10 (see FIGS. 1A-2C, 4A-5C), the aero-contouring system 130 (see FIG. 6), and the method 150 (see FIG. 7) for aero-contouring provide an aero-contouring apparatus 10 that is preferably a random orbit motion type capable of random orbit motion 132 (see FIG. 6) to reduce the instance of swirl marks in the surface 50 (see FIG. 6) of the aerodynamically functional coating 214 (see FIG. 6). In addition, all parts of the aero-contouring apparatus 10 that contact coated or painted surfaces 50*a* are preferably made of a material that does not leave residue that can affect subsequent coating operations.

Moreover, disclosed embodiments of the aero-contouring apparatus 10 (see FIGS. 1A-2C, 4A-5C), the aero-contouring system 130 (see FIG. 6), and the method 150 (see FIG. 7) for aero-contouring may reduce the amount of time and skill necessary to manually aero-contour the surface 50 to be aero-contoured and allows for less skilled operators to produce desired results by preventing or minimizing excessive pressure to the surface 50 to be aero-contoured and by preventing or minimizing gouging of the surface 50 by enabling tipping the aero-contouring apparatus 10 during operation. In addition, the method 130 of aero-contouring may be performed manually or may be automated. Finally, disclosed embodiments of the aero-contouring apparatus 10 (see FIGS. 1A-2C, 4A-5C), the aero-contouring system 130 (see FIG. 6), and the method 150 (see FIG. 7) for aero-contouring may provide improved quality and aesthetics of surface finishes for marketing differentiation.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting or exhaustive. Although specific terms are employed herein, they are used in a generic and descriptive sense only and not for purposes of limitation.

What is claimed is:

1. An aero-contouring apparatus comprising:

a housing assembly;

a motor assembly disposed within the housing assembly, the motor assembly comprising a motor unit and a drive unit;

an engagement force/tilt limiting member coupled to the housing assembly, the engagement force/tilt limiting member having a central through opening and having a substantially flat bottom end configured to maintain a gap between the bottom end and a surface to be aero-contoured of an aerodynamically functional coating applied to a structure, the engagement force/tilt limiting member comprising a machined ring member having a converging nozzle portion with a first tapered portion tapering downwardly from an outer rim portion of the machined ring member to the bottom end, and comprising a diverging nozzle portion with a second tapered portion tapering upwardly from the bottom end to the central through opening, the substantially flat bottom end having a radial thickness greater than a radial thickness of the first tapered portion and greater than a radial thickness of the second tapered portion, where the radial thickness is in relation to a centerline axis through the central through opening; and, an abrading unit coupled to the drive unit and inserted through the central through opening in non-contact communication with the engagement force/tilt limiting member, the abrading unit driven by the drive unit in a random orbit motion on the surface, the housing assembly, the motor assembly, the engagement force/tilt limiting member, and the abrading unit, together comprising an aero-contouring apparatus for aero-contouring the surface, wherein the engagement force/tilt limiting member mechanically limits both an engagement force and any tilting motion of the abrading unit with respect to the surface.

2. The apparatus of claim 1 wherein the housing assembly comprises a grip portion configured for manually holding the aero-contouring apparatus during manual operation.

3. The apparatus of claim 1 wherein the housing assembly comprises a vacuum outlet port configured for attachment to a debris collection system.

4. The apparatus of claim 3 wherein the converging nozzle portion and the diverging nozzle portion together accelerate a suction driven air flow velocity within the gap at the surface to be aero-contoured to entrain abrading debris for collection in the debris collection system.

5. The apparatus of claim 1 wherein the outer rim portion has a non-squared edge configuration comprising a beveled configuration, a radiused configuration, or a continuous curve configuration.

6. The apparatus of claim 1 wherein the engagement force/tilt limiting member is made of a material that prevents or minimizes transfer of any contaminant material or residue material from the engagement force/tilt limiting member to the surface to be aero-contoured.

7. The apparatus of claim 1 wherein the aero-contouring apparatus is configured for performing touch-up aero-contouring of the surface, and the housing assembly comprises one or more cut-out portions forming a viewing feature enabling an operator to view an aero-contouring location on the surface during touch-up aero-contouring with the aero-contouring apparatus.

8. The apparatus of claim 1 wherein the abrading unit comprises an abrading pad having a first side and a second side, a connector element attached to the first side and configured for connection to the drive unit, and an abrading media attached to the second side and configured for abrading the surface.

9. The apparatus of claim 1 wherein the abrading unit has an outer diameter with a length in a range of from about 1 inch to less than about 3 inches.

10. An aero-contouring system comprising:

a structure coated with an aerodynamically functional coating, the aerodynamically functional coating having a surface to be aero-contoured;

an aero-contouring apparatus for aero-contouring the surface, the aero-contouring apparatus comprising:

a housing assembly;

a motor assembly disposed within the housing assembly, the motor assembly comprising a motor unit and a drive unit;

an engagement force/tilt limiting member coupled to the housing assembly, the engagement force/tilt limiting member having a central through opening and having a substantially flat bottom end configured to maintain a gap between the bottom end and the surface, the engagement force/tilt limiting member comprising a machined ring member having a converging nozzle portion with a first tapered portion tapering downwardly from an outer rim portion of the machined ring member to the bottom end, and comprising a diverging nozzle portion with a second tapered portion tapering upwardly from the bottom end to the central through opening, the substantially flat bottom end having a radial thickness greater than a radial thickness of the first tapered portion and greater than a radial thickness of the second tapered portion, where the radial thickness is in relation to a centerline axis through the central through opening; and, an abrading unit coupled to the drive unit and inserted through the central through opening in non-contact communication with the engagement force/tilt limiting member, the abrading unit driven by the drive unit in a random orbit motion on the surface, wherein the engagement force/tilt limiting member mechanically limits both an engagement force and any tilting motion of the abrading unit with respect to the surface.

11. The system of claim 10 further comprising a debris collection system configured for attachment to a vacuum outlet port coupled to the housing assembly.

12. The system of claim 11 wherein the converging nozzle portion and the diverging nozzle portion together accelerate a suction driven air flow velocity within the gap at the surface to be aero-contoured to entrain abrading debris for collection in the debris collection system.

13. The system of claim 10 wherein the structure comprises one or more of a tail of an air vehicle, including a vertical stabilizer tail portion and horizontal stabilizer tail portions; wings of an air vehicle, including winglets; fuselage of an air vehicle; and nacelles of an air vehicle.

14. The system of claim 10 wherein the aerodynamically functional coating comprises an aerodynamically functional film element.

15. The system of claim 10 wherein the aero-contouring apparatus is configured for performing touch-up aero-contouring of the surface, and the housing assembly comprises one or more cut-out portions forming a viewing feature enabling an operator to view an aero-contouring location on the surface during touch-up aero-contouring with the aero-contouring apparatus.

16. A method for aero-contouring a surface of an aerodynamically functional coating applied to a structure, the method comprising the steps of:

contacting with an aero-contouring apparatus a surface to be aero-contoured of an aerodynamically functional coating applied to a structure, the aero-contouring apparatus comprising:

a housing assembly;

a motor assembly disposed within the housing assembly, the motor assembly comprising a motor unit and a drive unit;

an engagement force/tilt limiting member coupled to the housing assembly, the engagement force/tilt limiting member having a central through opening and a substantially flat bottom end configured to maintain a gap between the bottom end and the surface to be aero-contoured, the engagement force/tilt limiting member comprising a machined ring member having a converging nozzle portion with a first tapered portion tapering downwardly from an outer rim portion of the machined ring member to the bottom end, and comprising a diverging nozzle portion with a second tapered portion tapering upwardly from the bottom end to the central through opening, the substantially flat bottom end having a radial thickness greater than a radial thickness of the first tapered portion and greater than a radial thickness of the second tapered portion, where the radial thickness is in relation to a centerline axis through the central through opening; and, an abrading unit coupled to the drive unit and inserted through the central through opening in non-contact communication with the engagement force/tilt limiting member;

moving the aero-contouring apparatus in a random orbit motion on the surface to abrade and smooth the surface;

mechanically limiting with the engagement force/tilt limiting member an engagement force and any tilting motion of the abrading unit with respect to the surface; and, removing or minimizing any surface inclusions and coating edges on the surface without resulting in excessive engagement force to the surface and gouging of the surface.

17. The method of claim 16 further comprising the step of using the engagement force/tilt limiting member to accelerate a suction driven air flow velocity at the surface to entrain abrading debris for collection in a debris collection system.

18. The method of claim 17 wherein the step of using the engagement force/tilt limiting member to accelerate the suction driven air flow velocity comprises using the converging nozzle portion and the diverging nozzle portion formed on the engagement force/tilt limiting member to accelerate the suction driven air flow velocity within the gap.

19. The method of claim 16 further comprising the step of enabling touch-up aero-contouring on the surface with the aero-contouring apparatus by removing one or more cut-out portions from the housing assembly to form a viewing feature to view an aero-contouring location on the surface.

20. The method of claim 16 wherein the step of contacting the surface with the abrading unit comprises contacting the surface with an abrading unit having an outer diameter with a length in a range of from about 1 inch to less than about 3 inches.

* * * * *